US008596616B1

(12) United States Patent
Soot

(10) Patent No.: US 8,596,616 B1
(45) **Date of Patent: *Dec. 3, 2013**

(54) WINCH FOR RAISING AND LOWERING THEATRE SCENERY

(76) Inventor: Olaf Soot, Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/317,818

(22) Filed: Oct. 31, 2011

Related U.S. Application Data

(63) Continuation-in-part of application No. 12/807,318, filed on Sep. 3, 2010.

(60) Provisional application No. 61/517,210, filed on Apr. 16, 2011.

(51) Int. Cl.
*B66D 3/08* (2006.01)

(52) U.S. Cl.
USPC ..... 254/394; 254/334; 254/336; 254/393

(58) Field of Classification Search
USPC ..... 254/334, 336, 338, 393, 395, 278, 385, 254/394
See application file for complete search history.

(56) References Cited

U.S. PATENT DOCUMENTS

| | | | | |
|---|---|---|---|---|
| 1,821,563 | A * | 9/1931 | Mitchell et al. | 254/295 |
| 4,324,386 | A * | 4/1982 | Gagnon et al. | 254/288 |
| 4,446,587 | A * | 5/1984 | Jump | 5/83.1 |
| 4,662,628 | A * | 5/1987 | Chatenay epouse Compagnone | 472/77 |
| 5,361,565 | A * | 11/1994 | Bayer | 254/292 |
| 5,924,965 | A * | 7/1999 | Vardy | 482/112 |
| 6,520,485 | B1 * | 2/2003 | Soot | 254/331 |
| 6,561,368 | B1 * | 5/2003 | Sturm et al. | 212/319 |
| 6,827,334 | B2 * | 12/2004 | Volle et al. | 254/285 |
| 6,889,958 | B2 * | 5/2005 | Hoffend, Jr. | 254/276 |
| 7,243,870 | B2 * | 7/2007 | Pook et al. | 242/278 |
| 7,258,325 | B2 * | 8/2007 | Hoffend, Jr. | 254/394 |
| 7,364,136 | B2 * | 4/2008 | Hossler | 254/278 |
| 7,377,398 | B2 * | 5/2008 | Lichinchi | 212/175 |
| 7,484,712 | B2 * | 2/2009 | Hossler | 254/331 |
| 7,562,863 | B2 * | 7/2009 | Kochan et al. | 254/394 |
| 7,766,308 | B2 * | 8/2010 | Kochan et al. | 254/394 |
| 8,196,900 | B2 * | 6/2012 | Kempf | 254/385 |
| 2006/0163548 | A1 * | 7/2006 | Kochan et al. | 254/278 |
| 2006/0284151 | A1 * | 12/2006 | Hossler | 254/278 |
| 2009/0309081 | A1 * | 12/2009 | Kempf | 254/336 |

* cited by examiner

*Primary Examiner* — Emmanuel M Marcelo
*Assistant Examiner* — Michael Gallion

(57) ABSTRACT

A motorized improved winch for raising and lowering, for example, theater scenery by means of cables and which incorporates a tubular support enclosure for supporting and housing a moving drum and the required components for driving, emergency braking and for moving the drum in synchronization with relation to the cable guiding means, preferably mounted on the tubular support enclosure, and for driving the electrical sensors if desired. A new feature of this improved winch includes alternate means for supporting the winch unit from the tubular support enclosure through rollers, mounted to the inside of the tubular support enclosure and engaging the support means part of the movable winch unit. Another new feature is an option to use more than one driving means for increased capacity. The improved winch can be installed at the sides of the stage, up at the stage gridiron, or above the gridiron.

14 Claims, 21 Drawing Sheets

WINCH FOR RAISING AND LOWERING THEATRE SCENERY

This is a Continuation-in-Part of application Ser. No. 12/807,318, filed Sep. 3 2010, and is also based on U.S. Provisional Patent Application 61/277,442, filed Sep. 23, 2009, and U.S. Provisional Patent Application 61/517,210, filed Apr. 16, 2011.

This invention is directed to raising and lowering objects, in particular objects, such as theater scenic elements, suspended from fly sets, by improved fail-safe motorized means.

BACKGROUND OF INVENTION

In most theaters the scenery is hung from manually operated fly sets. Each set usually consists of a pipe batten hung parallel to the proscenium opening from cables approximately 8-12 ft. apart.

Each cable passes from the pipe batten over loft blocks, mounted on the gridiron or to the underside of the roof beams. From the loft blocks the cables lead over a common headblock, mounted at the side of the stage, usually approximately level with the loft blocks, and down to a counterweight arbor. The counterweight arbor is typically a steel frame, supporting lead, and steel or cast iron weights. It is guided by tracks or cables, which are mounted on the stage sidewall. The weight of the counterweight arbor is balanced to be approximately equal to the weight of the pipe batten and the set hung from the pipe batten.

The fly set is lifted or lowered by an operating rope, tied on top of the counterweight arbor, passing up over and around the head block, down around a tension sheave and up again through a friction lock to the bottom of the counterweight arbor. The friction lock holds the nearly balanced pipe batten and the counterweight arbor in position.

The pipe battens are usually spaced at 6 to 8 inches on centers. The number of sets varies. 20-30 may be used in smaller theaters while more than 100 in larger theaters. The system has several disadvantages. Loading and unloading counterweights for balancing the loads is time-consuming and dangerous. There have been many accidents when counterweights were dropped from a 60-80 feet above the stage. Also, in case of excessive unbalance the fly set may run away when the rope lock is opened.

Motorized winches have been used in larger theaters. In the past most of them have been one of kind designs, developed specifically for the particular applications. More recently standardized winches have become available, but are still considerably more costly than the manually operated fly sets.

Motorized fly sets are generally spaced wider apart than the manual sets. 8 inch center-to-center spacing has become an accepted standard in the US. The standardized winches presently available are wider than 8 inches and therefore cannot be mounted side by side in a single row. Double row or staggered winch mounting is required for these winches for spacing the fly sets at 8-inch centers.

Some of the standardized fly set winches are zero fleet angle type, meaning that the angle of the cables between the cable drum and the loft block sheaves, mounted on the winch base, does not change when the cables wind or unwind on the drum. This feature is achieved by translating the drum in its longitudinal direction with respect to the sheaves, in synchronization with the back and forth travels of the cables in the drum cable grooves. As an alternate, the drum can be stationary and the loft block sheaves can be translated in similar manner with respect to the drum. This translation can be accomplished by a screw, with the thread pitch identical or in fixed ratio with the spacing of the cable grooves in the drum. The screw can be non-rotatably mounted to the winch base. It would engage a rotating nut, part of the winch. As an option the screw can be rotatably mounted on the winch engaging a fixed nut mounted on the winch base. As another option, the grooves in the winch drum can be used for translating the drum in its longitudinal direction through a device such as a rotating cam or wheel mounted on the winch base and engaging the drum grooves. In this case the drum grooves act as screw thread.

All the existing above described winches are mounted on external base structures and use separate protective enclosures around the winch moving parts.

BRIEF SUMMARY OF INVENTION

An object of the present invention is an improved winch that combines the functions of the winch base structure and a protective winch enclosure into a single component tubular support enclosure.

Another object of the present invention is an improved zero fleet angle winch where the tubular support enclosure includes means for mounting the winch unit inside the tubular support enclosure such that it or its drum can be moved back and forth parallel to its longitudinal axis inside the tubular support enclosure.

A further object of the present invention is an improved zero fleet angle winch configured in such manner that the motor, gear reducer and an overspeed brake, part of the winch unit, all mounted inside the tubular support enclosure, are accessible for maintenance or replacement without removing the winch unit from its tubular support enclosure or from its mounted location in the facility.

Yet another object of the invention is an improved zero fleet angle winch that is compact, requires reduced maintenance, and is sufficiently versatile that it can be easily adapted for mounting along the theater sidewalls or to the gridiron or to the overhead structure and where the winches can be mounted at approximately 8" on centers with respect to each other.

A principal feature of this invention is a winch construction of which the winch unit is mounted inside a tubular support enclosure that supports and guides the winch unit while providing access to movable components of the winch unit for maintenance and repair. In a preferred embodiment, a sheave assembly and a sensor unit are mounted on the bottom side of the tubular support enclosure. In a preferred embodiment, the control sensor contains up and down position and overtravel limit switches which can be selectively adjusted for each particular installation and also for maintenance. It also may contain an absolute encoder, for example, a rotary or shaft encoder, for setting the fly set variable position travel stops and speed control.

A feature of the invention is that the winch construction is confined within a right quadrangular volume defined by the enclosure sides and straight prolonged extensions of the sides with the result that plural winches can be mounted side-by-side without fear of winch component interference.

A further feature is that mounting of the sheave assembly to and outside of the enclosure allows construction of a structurally sound enclosure that will protect the winch components while allowing full access to maintainable winch parts, including removal and replacement of the cables without removing the winch unit from its tubular enclosure.

A new feature of the invention described in this CIP application is that the use of rollers, mounted to the inside of the tubular support enclosure engaging the motor and brake end supports of the movable winch unit, reduce friction and permit the use of steel for these end supports for reduced wear and improved operational life.

Yet another new feature of this invention is that by adding a second motorized gear reducer for rotating the drum assembly, the winch lifting capacity or speed or both, can be increased while still maintaining the width of the winch within eight inches.

The various features of novelty, which characterize the invention, are pointed out with particularity in the claims annexed to and forming a part of this application. For a better understanding of the invention, its operating advantages and specific objects attained by its use, reference should be had to the accompanying drawings and descriptive matter in which there are illustrated and described the preferred embodiments of the invention, and in which like reference numerals denote the same or similar components.

DETAILED DESCRIPTION OF PREFERRED EMBODIMENTS

Figure 1:
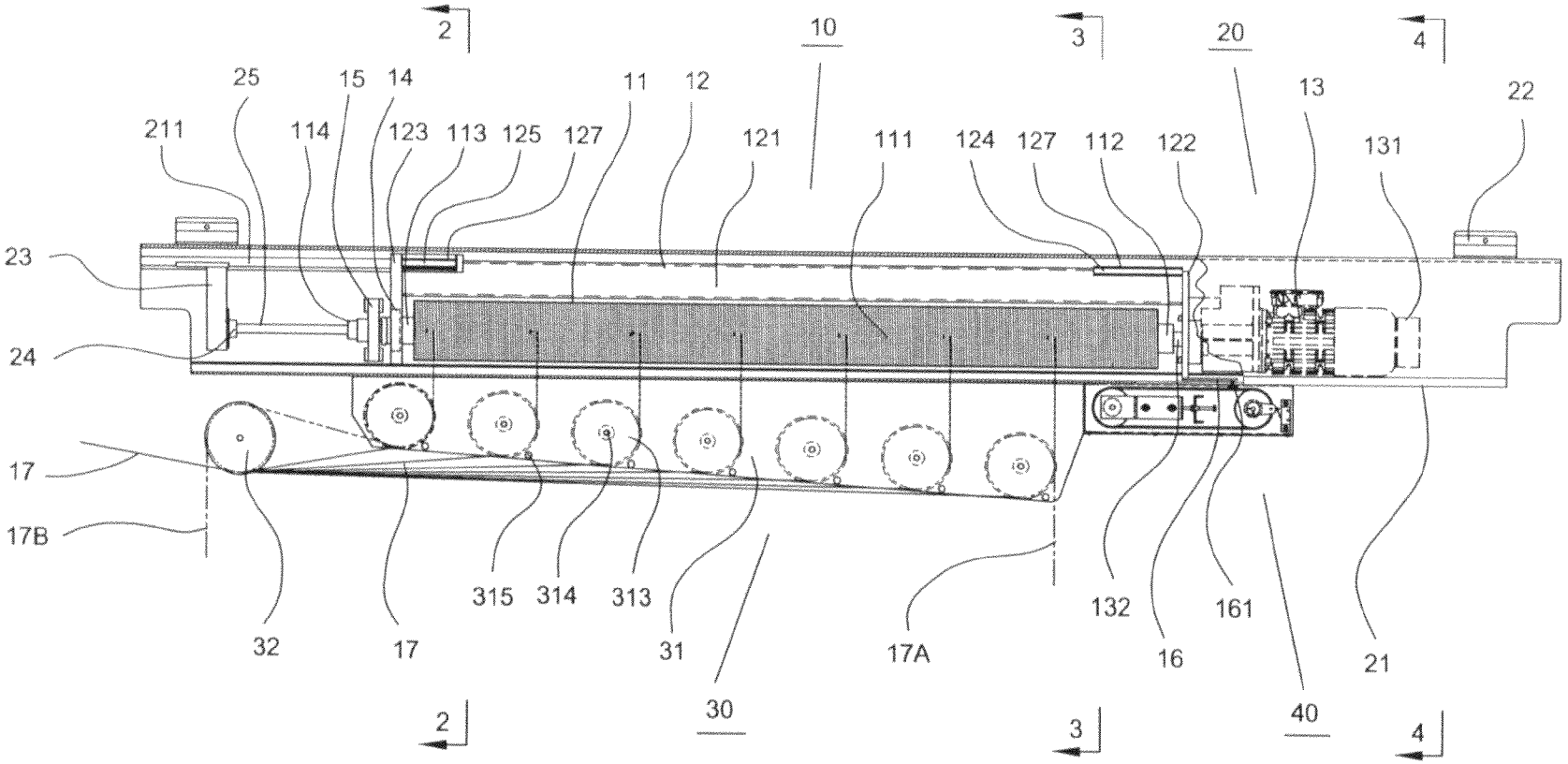
FIG. 1 is a side view of an improved winch in accordance with the invention shown in one configuration with the improved winch ready for mounting to a facility structure. The tubular support enclosure is partially cut to show the winch unit inside.

As used in this application, a "fly set" typically is the combination of a batten, loft blocks (sheaves) and one or more support lines, for example, a wire cable or rope, attached to the batten and engaging a loft block. Typically, the number of loft blocks equals the number of support lines. A "batten" is the structural member typically supporting a scenic element. Typically the batten is a steel or aluminum pipe, though other strip-type structural members can be substituted. When the scenery to be raised and lowered is, for example, a screen or backdrop extending laterally across the stage, the supporting batten typically has a length exceeding the width of the proscenium, i.e., the stage opening visible to the audience, and the batten would typically use 4-7 support lines spaced evenly across its top. As used herein, the terms "laterally" and "width" refer to the horizontal dimension or direction of the proscenium and the term "vertically" refers to the vertical dimension or direction of the proscenium. The "stage ceiling" is the ceiling of the stage tower that is above and behind the open curtain and not visible to the audience. It typically extends, when the scenery is lifted straight up and removed from the view of the audience, to a distance above the top of the proscenium equal to or greater than the height of the scenery. The term "gridiron" refers to a rigid structural member typically composed of steel beams that forms an open grid structure extending parallel to and typically 6-7 feet below the stage ceiling out of view of the audience and which is capable of supporting various objects. "Wells" in the gridiron are larger openings through which support cables can be extended to battens or other structures beneath.

In a preferred embodiment, the invention is directed to an improved winch for raising and lowering objects, such as theatre scenery, consisting of a winch unit mounted inside and supported by a tubular support enclosure. The winch unit incorporates functions for lifting, lowering and supporting the objects, for emergency braking, for translating the drum in its longitudinal direction in synchronization with winding and unwinding the cables from the drum so that the orientation of the cables is maintained in relation to the tubular support enclosure. The winch unit may also be used for driving the limit switches and an encoder for sensing and controlling object position. The tubular support enclosure supports the winch unit and the cable guiding sheaves. It may also be used for mounting limit switches, encoder, and electrical controls. By "tubular support enclosure" is meant an integral tubular unit comprising side, bottom and top panels enclosing preferably at least 60% of the winch unit. The remaining 40% includes openings, which may be covered by removable panels for accessing the winch unit for maintenance and repair.

One form of the improved winch according to the invention is shown in FIG. 1 and FIGS. 2, 3, 4. The important feature of this invention is that the winch unit 10 is mounted inside a tubular support enclosure 21, fixed to the facility, which tubular support enclosure 21 supports and guides the winch unit 10 while providing access to movable components of the winch unit for maintenance and repair. In the preferred embodiment a sheave assembly 30 and a sensor unit 40 are mounted on the bottom side of the tubular support enclosure 21.

Figure 2:
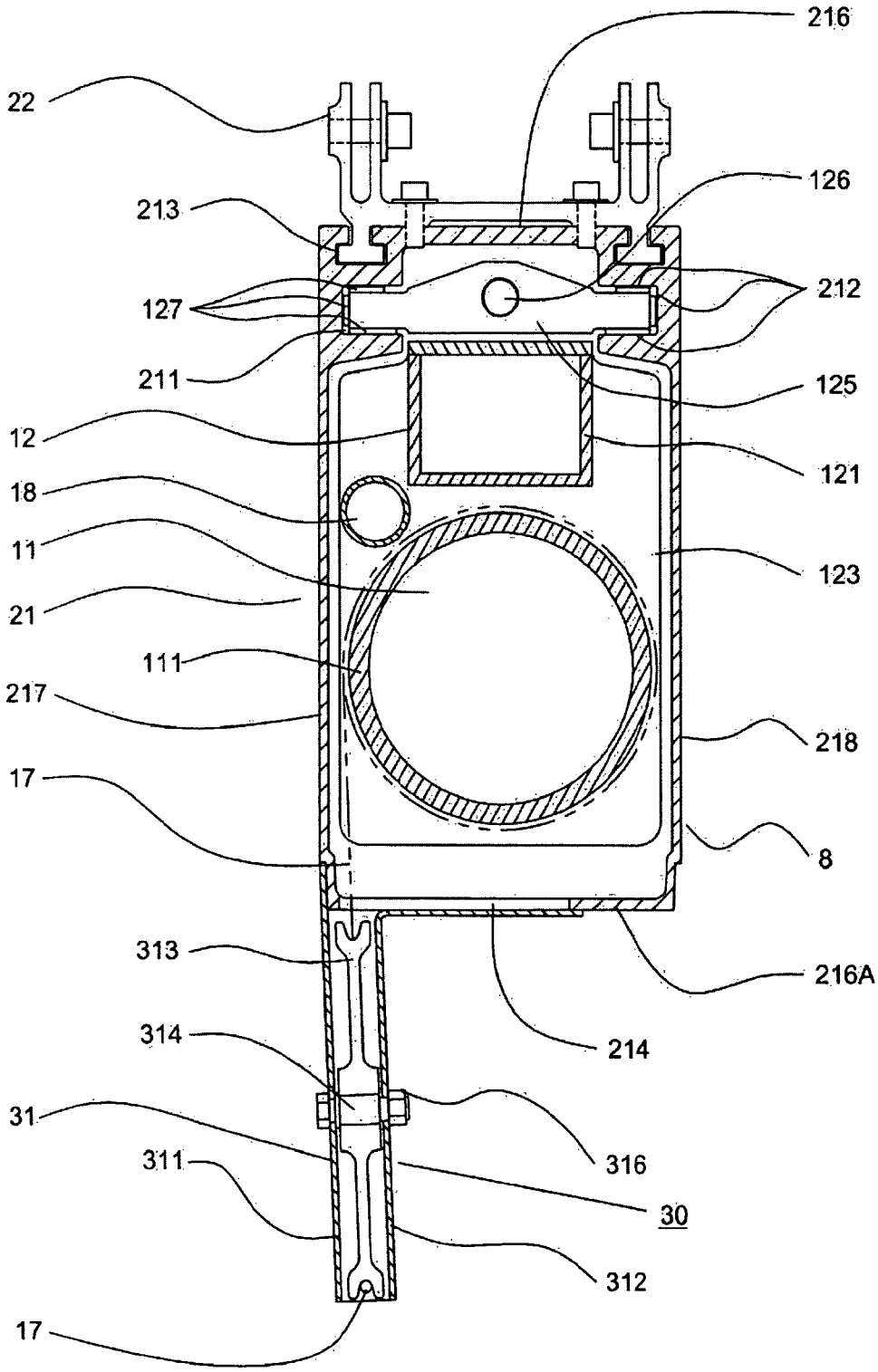
FIG. 2 is a cross sectional view of the improved winch taken along line 2-2 of FIG. 1, illustrating the brake end support, one arrangement of sheaves and sheave housing and tubular support enclosure geometry.

The form of winch unit 10 shown on FIG. 1 and FIG. 2 includes a drum assembly 11, rotatably supported and directly driven at one end through a motorized gear reducer 13 mounted on a motor end member 122, part of a frame 12, all translatable along the longitudinal axis of drum assembly 11 inside the tubular support enclosure. The opposite end of cable drum assembly 11 is supported from a bearing 14 through an elongated hub 113, part of, or bolted to the cable drum grooved portion 111 brake end. The bearing 14 can be mounted into a frame 12 brake end member 123. The elongated hub 113 includes means for connecting it to an overspeed brake 15, which would engage in case of overspeed drum rotation, if caused by the motorized gear reducer 13 or a motor brake 131 failure. Under normal conditions, the load on the winch unit 10 is held by the motor or the motor brake 131, which are parts of the motorized gear reducer 13.

Figure 3:
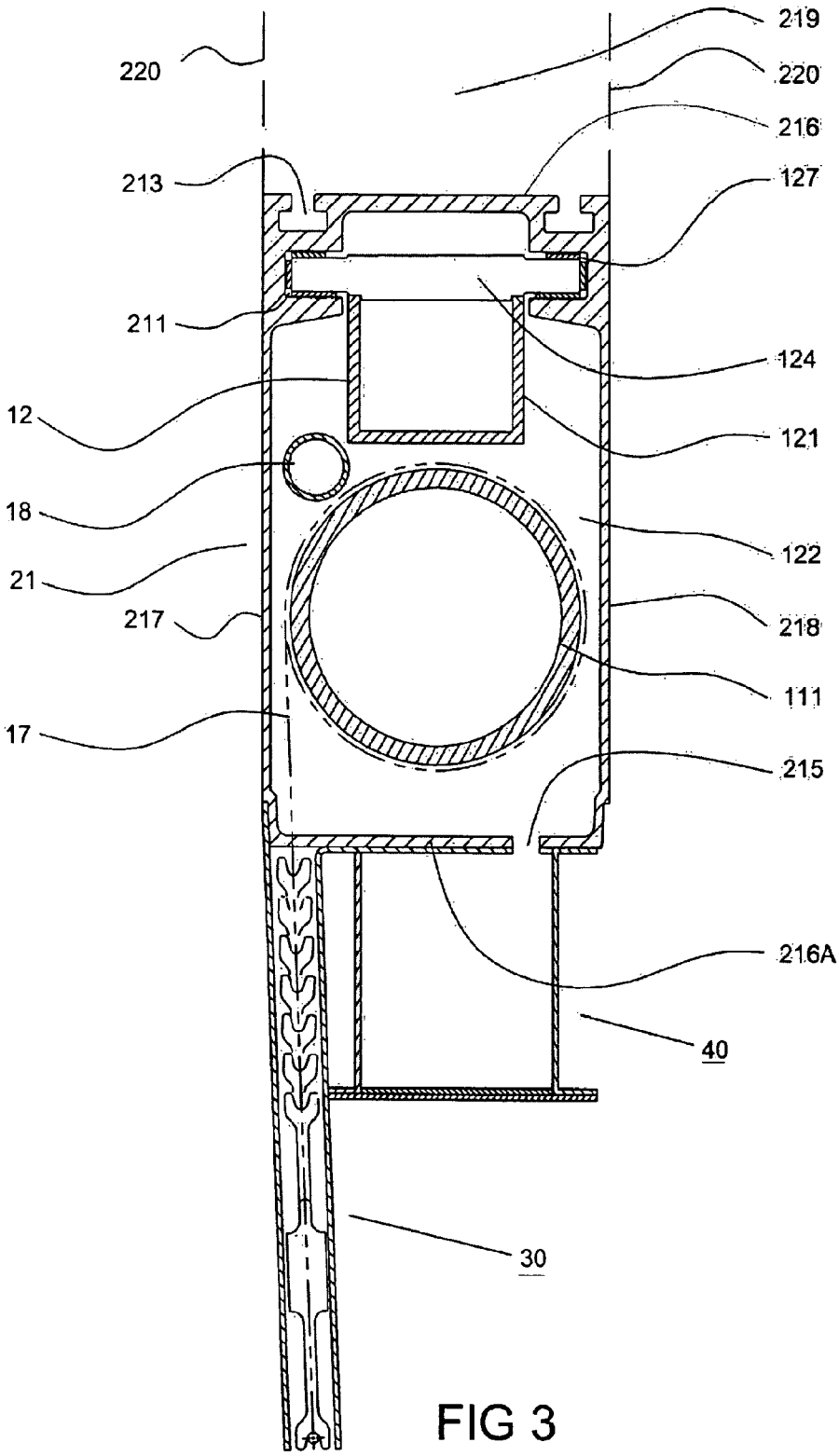
FIG. 3 is a cross sectional view of the improved winch taken along line 3-3 of FIG. 1, illustrating the motor end support, one arrangement of sheave and sheave housing, mounting of the sensor assembly and tubular support enclosure geometry.

In the preferred embodiment the winch unit 10 is mounted into the tubular support enclosure 21 so that it can be moved back and forth parallel to the longitudinal axis of the drum assembly 11, relative to the tubular support enclosure 21, and, as shown on FIG. 2, supported inside the tubular support enclosure 21 by support and guide recessed sections such as guide grooves 211 through sliding bearings 127 fastened to the motor end support 124 and to the brake end support 125 of the frame 12. Single or plural cables 17 pass from the drum grooved portion 111 over their respective vertically and/or horizontally offset cable-guiding sheaves 313, over respective loft blocks 56 (as shown on FIGS. 13, 14, 15, 16) to a pipe batten 57 used for supporting the stage sets. For some installations, when required due to the facility layout and geometry, the cables 17 can be further directed over or below a guide block 32 fastened to the tubular support enclosure 21. In the configuration shown on FIG. 1 and FIG. 2, the tubular support enclosure 21 is mounted to the facility structure (not shown) by means of brackets 22. In FIG. 3, the preferred tubular enclosure is rectangular with side panels or-walls 217 and 218 and bottom panel or-wall 216A below, which extends the sheave assembly. Looking again at FIG. 1, when the rotating drum assembly 11 winds or unwinds the cables 17, the cables travel back and forth in the drum grooved portion 111 grooves. Therefore, in order to provide straight cable runs between the drum grooved portion 111 and horizontally fixed cable guiding sheaves 313, the winch unit 10 has to travel laterally (parallel to the drums axis) in synchronization with and in the same direction as the cable back and forth travel in the drum grooved portion 111 grooves. By a "straight cable run" is meant that the angular orientation between the drum grooved portion 111 and the cable guiding sheaves 313 in maintained in a vertical orientation when the improved winch system is mounted horizontally, and when the improved winch system is mounted vertically, the cables are maintained in a horizontal orientation. If the winch system is mounted at an angle, then the cable angular orientation is maintained to maintain a straight cable run.

In the configuration shown in FIG. 1, the drum assembly 11 is used for horizontally moving the winch unit 10 inside the tubular support enclosure 21 in relation to the fixed cable guiding sheaves 313. The movement is fixed in synchronization with the cable 17 back and forth travel in the drum grooved portion 111 grooves. This is accomplished, in accordance with a preferred embodiment, by a power transmission screw 25 (ACME, ball or roller type), connected non-rotatably through a connector 24 to screw 25 support 23, inside the tubular support enclosure 21. A power transmission nut 114 (ACME, ball or roller type) is mounted to the drum assembly 11 brake end hub 113, which hub is hollow so that the power transmission screw 25 can pass, via the hollow hub, inside the drum assembly 11, which is also hollow, where the screw 25 is protected when the pipe batten hung from winch unit 10 is in its up, or storage, position. The view of FIG. 1 with the power transmission screw 25 extending outside the drum assembly 11 occurs when the pipe batten is at its down position. Storing the power transmission screw 25 inside the drum assembly 11 is possible because the drum is not mounted on a separate shaft, but the drum itself forms its own shaft. The power transmission nut 114, being secured to the hub 113, rotates together with the drum assembly 11 and also with respect to screw 25. The pitch of the screw 25 thread is equal to the pitch of the drum grooved portion 111 cable grooves. Therefore, the winch unit 10 is moved in synchronization with the back and forth travels of the cables 17 in the drum grooved portion 111 grooves. Straight cable runs/paths are maintained between the winch unit 10 and the cable guiding sheaves 313.

Another option is to mount the power transmission screw 25 rigidly to the end of the drum assembly 11 and to mount the power transmission nut 114 rigidly to the screw support 23. Now the power transmission screw 25 would rotate together with drum assembly 11, engage the fixed power transmission nut 114 and translate the drum assembly 11 together with the frame 12 and all the components mounted to the frame 12 relative to the tubular enclosure 21 in synchronization with the back and forth travel of cables 17 in drum assembly 11 grooved portion 111 grooves.

Looking at FIG. 1, the drum assembly 11 can be constructed of a cylindrical tubular member having the grooves 111 machined in its outer surface, with hubs 112 and 113 at each end. The hubs can be bolted or welded to the grooved drum grooved portion 111. Suitable materials for the cable drum grooved portion 111 are aluminum and steel. Other materials or their combinations can be used. For example, the drum grooved portion 111 can be made of one un-grooved tubular member with short pre-grooved cylindrical portions installed around and supported by the un-grooved tubular member. Likewise the drum grooved portion 111 can be made of short cylindrical grooved portions, held together by post-tensioned ties or by similar means.

In the embodiment shown in FIG. 1 the drum assembly 11 is mounted into the drum support frame 12, which comprises of one rigid horizontal member 121, motor end vertical member 122, brake end vertical member 123, motor end support 124 and brake end support 125. The motor end vertical member 122 can be made of steel or aluminum plates or castings, incorporating all mounting interfaces for the motorized gear reducer 13. The brake end vertical member can be made of steel or aluminum plates or castings, incorporating all mounting interfaces for the anti-friction bearing 14, overspeed brake 15 and, as shown on FIG. 2, shaft 126. The horizontal member 121 can be made of steel or aluminum tubing.

A protective device 18 shown on FIG. 2 is a roller assembly. On FIG. 6 the protective device 18A is configured as a curved cover. Protective devices can be mounted on the frame 12 for preventing and/or sensing the cables 17 from jumping the drum grooved portion 111 grooves. The protective devices 18 can have electricity conductive surfaces (not shown) normally insulated from the frame 12. Should a cable 17 develop slack or cross the drum grooved portion 111 groove, the cable will touch these conductive surfaces and ground these surfaces to the frame 12. A ground fault detector, part of electrical controls, would then stop the winch 10 operation. Another type of protective device can be a wire (not shown), tensioned close to the outside diameter of the drum or rollers supported by a wire or a rod (not shown) mounted close to the outside diameter of the cables 17 wound on drum grooved portion 111 between the frame 12 end members 122 at motor end and 123 at the brake end. This wire can also be insulated from the frame 12 and act as a ground fault detector as described above.

As shown on FIG. 1 and FIG. 3 the motor end support 124 is a rigid part of frame 12, connected to the top member 121 and motor end member 122. Bearings 127 are mounted on the motor end support 124 surfaces interfacing with the tubular support enclosure 21 guide surfaces 212.

As shown on FIG. 1 and FIG. 2 the brake end support 125 is mounted to the frame 12 through shaft 126. This permits the brake end support 125 to pivot about the longitudinal axis of shaft 126 and frame 12 so as compensate for possible tubular support enclosure 21 guide surfaces 212 and support and guide groove 211 irregularities. Bearings 127 are mounted on the brake end support 125 interfacing with the support and guide surfaces 212 of the tubular support enclosure 21.

One important feature of the above arrangement of the supports 124 and 125 is that all the forces caused by the drive torque from the motorized gear reducer 13 are resisted by the motor end support 124 while the brake end support 125 supports the vertical and lateral forces only. Likewise, if the overspeed brake 15 engages, its torque is applied to the brake end member 123 and transferred through the top member 121 to the motor end support 124, which will resist the forces applied by the overspeed brake 15 torque.

The overspeed brake 15 can be centrifugal type used in other fly system winches. It can be also solenoid-applied type or spring applied electrically released brake similar to what is used in the industry for motors and other rotating devices.

Looking at FIG. 1, FIG. 2, and FIG. 3, another option for the frame (not shown) is to eliminate the top axial-extending beam-like member 121. The tie between the vertical motor end member 122 and brake end member 123 would then be formed by the drum assembly 11. In this case the motor end vertical member 122 and the motor end support 124 have to be rigid to resist all the drive torques from the motorized gear reducer 13 and in addition the frictional forces between the bearings 127 and the tubular support enclosure 21 support and guide surfaces 212. Likewise the brake end vertical member 125 and the brake end support 123 have to be rigid, similar to the motor end support, in order to resist the braking torque from the overspeed brake 15 and in addition, the frictional forces between the bearings 127 and the tubular support enclosure 21 support and guide surfaces 212.

In the configuration shown on FIG. 1 and FIG. 2 the bearings 127 are used as sliding bearings between the winch unit 10 and tubular support enclosure 20. These bearings can be made of PTFE or PTFE compounds. The bearings 127 can be glued or mechanically fastened to the motor end support 124 and to the brake end support 125. As an alternate (not shown here) anti-friction ball or roller bearings or cam followers can be used instead of the sliding bearings.

A feature of this invention is combining the winch unit 10 supports, its guides and its protective enclosure into a tubular support enclosure 21 which also has connection means 213 (mounting bracket recessed sections such as grooves) for adjustably positioning the mounting brackets 22 with complementary-shaped T-shaped extensions to the tubular support enclosure 21 as illustrated on FIG. 1, FIG. 2 and FIG. 3. The tubular support enclosure 21, together with mounting brackets 22 forms the winch support 20, ready for installation to a facility. These grooves 213 by which the tubular enclosure is supported allow slidable adjustment of the bracket 22 spacing to suit the spacing of the facility beams to which the brackets will be fixed. Once the properly spaced brackets are secured to the facility, locking screws can be tightened to fix the tubular enclosure to the brackets.

Figure 7:
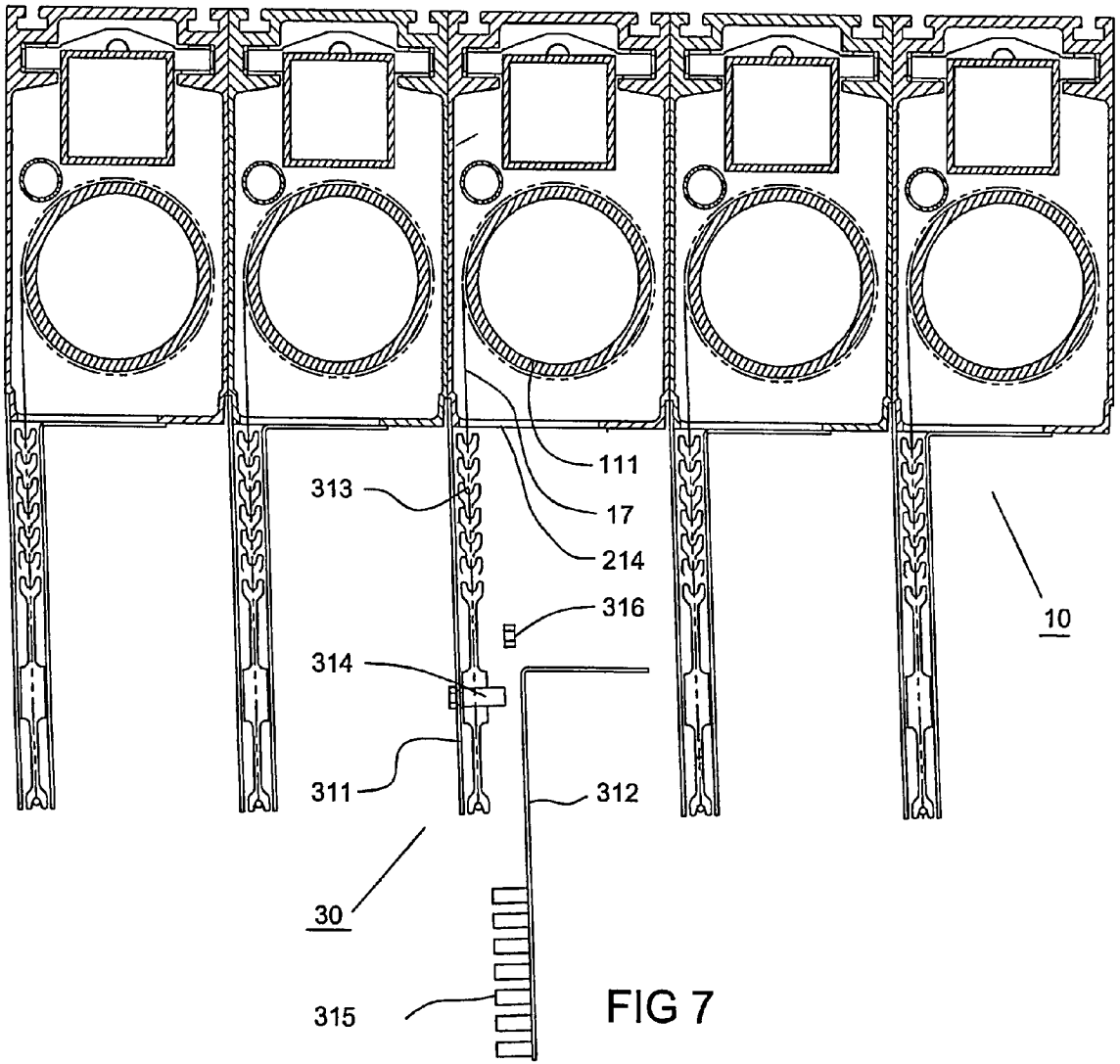
FIG. 7 is a cross sectional view showing several of the improved winches mounted side by side to a facility structure.

This invention as shown in FIG. 7 permits installation of the winches very close to each other (8 inches on centers), which is a standard spacing of the theater fly sets, without danger of interference between their adjacent moving parts and, as later described, it also provides access to all important winch unit 10 moving parts, including to the sensors for positioning and speed control, which may require service or replacement. It further permits removal and replacement of cables 17 without the need for removal of winch 10 from its mounts in the facility. This non-interfering close spacing is achieved by confining all winch components within a right quadrangular volume 219 defined by the enclosure side panels or walls left 217, right 218 and straight prolonged extensions of the sides, illustrated by the dashed line extensions 220 (FIG. 3). Note that no winch components lie outside that volume 219, and thus when the enclosures are mounted side-by-side (FIG. 7), no interference during operation will occur.

No other currently manufactured multi-cable winches permit such close spacing and in order to place the fly sets of 8-inch centers, these winches have to be installed in multiple rows or at different levels.

One problem in meeting this objective under the constraints are the drum diameters required by standards and codes, which, together with ¼ inch cable wrapped around it, would be approximately 7 inches. The second problem is that the standardized motor frame and gear reducer sizes which, for lifting about 2,500 pounds, would be approximately 7¼ inches wide. This invention makes it possible to mount all these winch elements inside a tubular support enclosure 21 that will resist vertical loads, longitudinal axial forces and torsion forces, with the outside dimension between the lines 220 on FIG. 3 not exceeding 8 inches.

Figure 6:
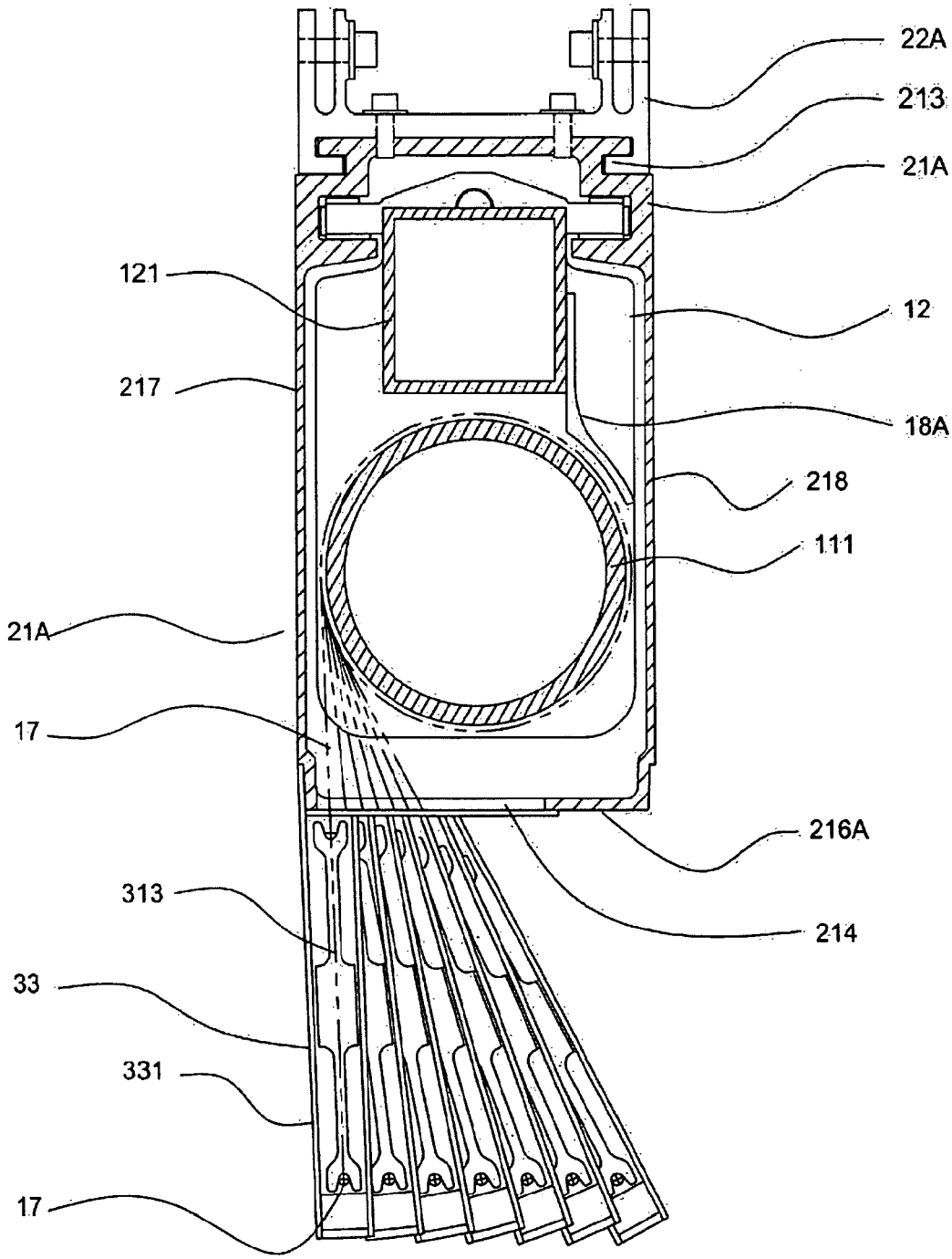
FIG. 6 is a cross sectional view of the improved winch taken along line 6-6 of FIG. 5 illustrating an alternate arrangement of sheaves, alternate mounting bracket and alternate support enclosure geometry.

Close mounting of the winches on 8" inch centers according to this feature of the invention is made possible by the cross-sectional profile of the tubular support enclosure 21, shown on FIG. 2 and FIG. 6. Referring now to FIG. 1, the tubular support enclosure 21 has to support vertical loads, as a beam applied on it through the brake end support 125 and the motor end support 124. It also has to support the longitudinal axial forces, applied by the cables 17 and by the power transmission screw 25. In addition, the tubular support enclosure 21 has to support torsion forces applied through the motor end support 124 to the support and guide grooves 211 as shown on FIG. 3. I have found that a thin walled tube is very efficient for supporting the torsion loads. This feature permits to use thin side walls for the tubular support enclosure 21, which in turn, provides maximum width inside the tubular support enclosure 21 for mounting the winch unit 10. The top and bottom walls and the portions around the support and guide grooves 211 of the tubular support enclosure 21 are made thicker to support the vertical forces in bending and to transfer the load concentrations from the motor end support 124 and brake end support 125 to the mounting brackets 22 without affecting the thin side walls below.

It should be noted that even if a winch unit 10 could be mounted inside a framed structure (not shown) and because a framed structure could not utilize thin side walls, an 8-inch winch side by side spacing would not be possible.

In the winch construction illustrated, the side panels or walls can be as thin as ⅛-¼ inches, preferably 3/16 inches. This will accommodate the width of codes and standards compliant drum assembly 11 and motorized gear reducer 13, with adequate clearances. The height can be increased to accommodate thicker top panels or walls 216 and thicker bottom panels or walls 216A if required for additional strength. The resultant thin-side-walled, thicker top-and-bottom walled tubular enclosure, even with the openings provided for access, will house the kind of winch unit described, provide a maximum overall enclosure width of 8 inches and will adequately resist the various stresses exerted during operation of the winch. Loads about 2500 lbs can be lifted with a motorized gear reducer 13 that fits into the 8 inch wide tubular support enclosure 21. Aluminum extrusions, with cross sectional profiles as shown as item 8 on FIG. 4 will provide sufficient strength for such an enclosure.

Figure 4:
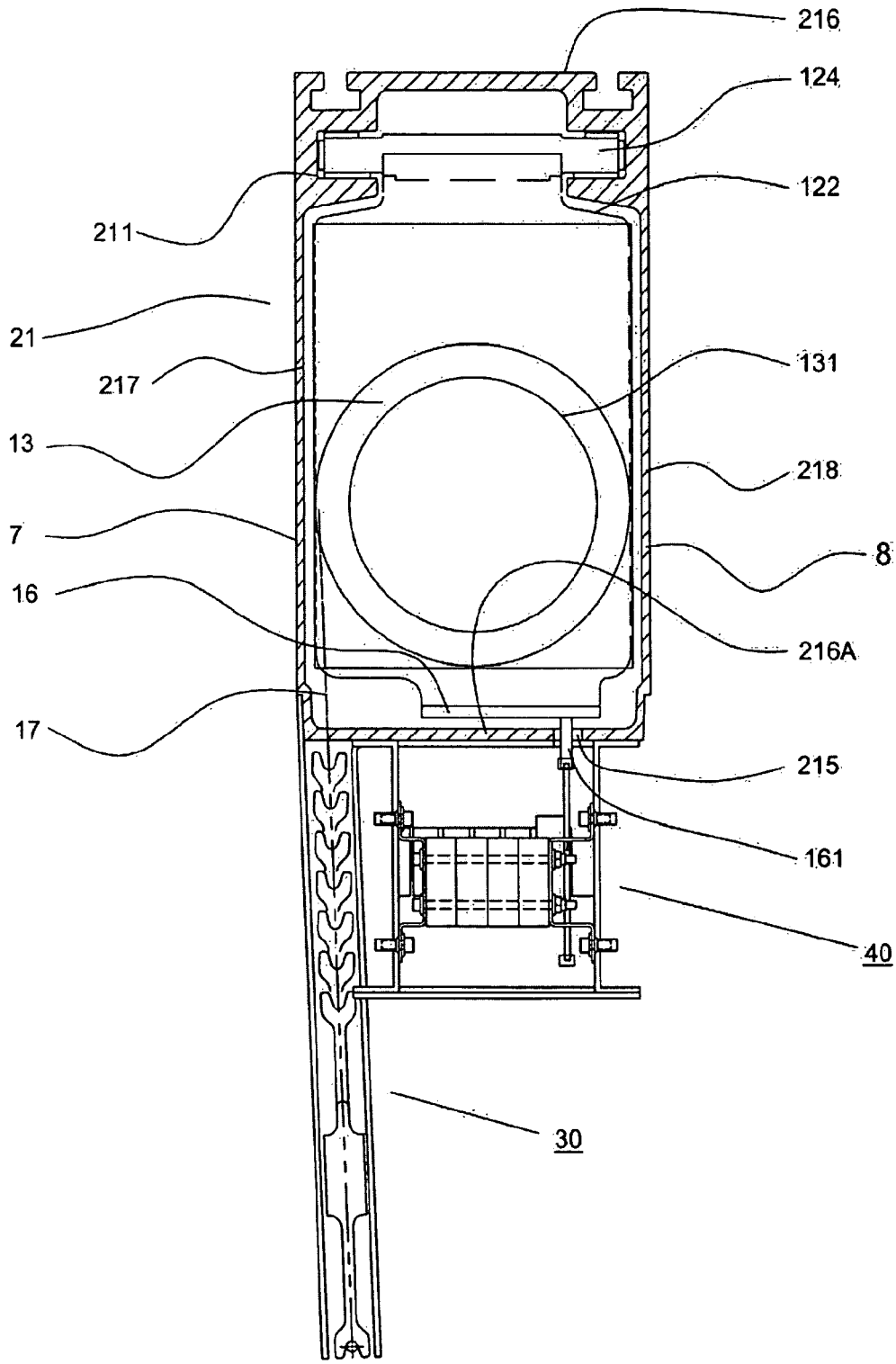
FIG. 4 is an end view of the improved winch taken at line 4-4 of FIG. 1 illustrating one type of mounting bracket for mounting the improved winch to the facility structure, one arrangement of sheaves and sheave housing, mounting of the sensor assembly, motorized gear reducer and support enclosure geometry.

In the preferred embodiment, referring to FIG. 4 the tubular support enclosure 21 is a substantially rectangular aluminum extrusion configured to form the support and guide grooves 211 together with bottom, side and top support and guide surfaces 212 for mounting the winch unit 10 into the tubular support enclosure 21 so that it can be moved back and forth during operation parallel to the longitudinal axis of the drum assembly 11. The grooves 213 for the mounting brackets 22, used for installation of winch 10 into the facility, can also be part of the tubular support enclosure 21. These grooves 213 can be inverted T shape as shown on FIG. 2 or horizontal as shown on FIG. 6. While the preferred embodiment describes an extruded aluminum tubular support enclosure 21, the tubular support enclosure with the support and guide grooves 211 can also be constructed of independent components (not shown), made of aluminum or other materials, welded and/or bolted together.

FIGS. 2 and 6 show access openings 214 cut on the bottom side of tubular support enclosure 21 for cables 17 passing from drum grooved portion 111 to the cable guiding sheaves 313. These openings can also be used for removal and installation of cables 17 to drum grooved portion 111. A slot 215, shown on FIG. 3 and FIG. 4, can be also cut on the bottom side of the tubular support enclosure 21 for connecting the sensor assembly 40 to the movable frame 12 through a sensor connecting pin 161 fastened to the bracket 16 (FIG. 1). Additional holes (not shown) may be provided for mounting the sheave assembly 30, optional guide block 32 (FIG. 1), the sensor assembly 40 and the screw support 23 to the tubular support enclosure 21. The power transmission screw 25 is non-rotatably mounted to the screw support 23 through screw connector 24. The power transmission screw 25 engages the power transmission nut 114 part of the winch unit 10 drum assembly 11.

According to FIGS. 1, 2, and 6 the tubular support enclosure 21 can be installed to the facility structure (not shown) through mounting brackets 22 and 22A. One type of mounting bracket 22 made from aluminum extrusion is shown on FIG. 1 and FIG. 2. The brackets 22 engage the recessed sections, preferably inverted T-shape grooves 213 in tubular support enclosure 21, and are inserted into these grooves. One bracket 22 can be bolted to the tubular support enclosure 21 in order to support the horizontal loads applied by the cables 17. Bolting would also eliminate the torsional movement of the tubular support enclosure 21 that may be caused by the torsion applied to the tubular support enclosure 21 by the motorized gear reducer 13 if excessive tolerance gaps exist between the brackets 22 and the grooves 213.

The second mounting bracket 22 can be but does not have to be bolted to the tubular support enclosure 21. Without bolting the second bracket 22 engages the grooves 213 and supports the vertical loads. Its position can be easily adjusted in the tubular support enclosure 21 by sliding it in the grooves 213 in the longitudinal direction so as to compensate for the interfacing facility structure tolerances.

Figure 5:
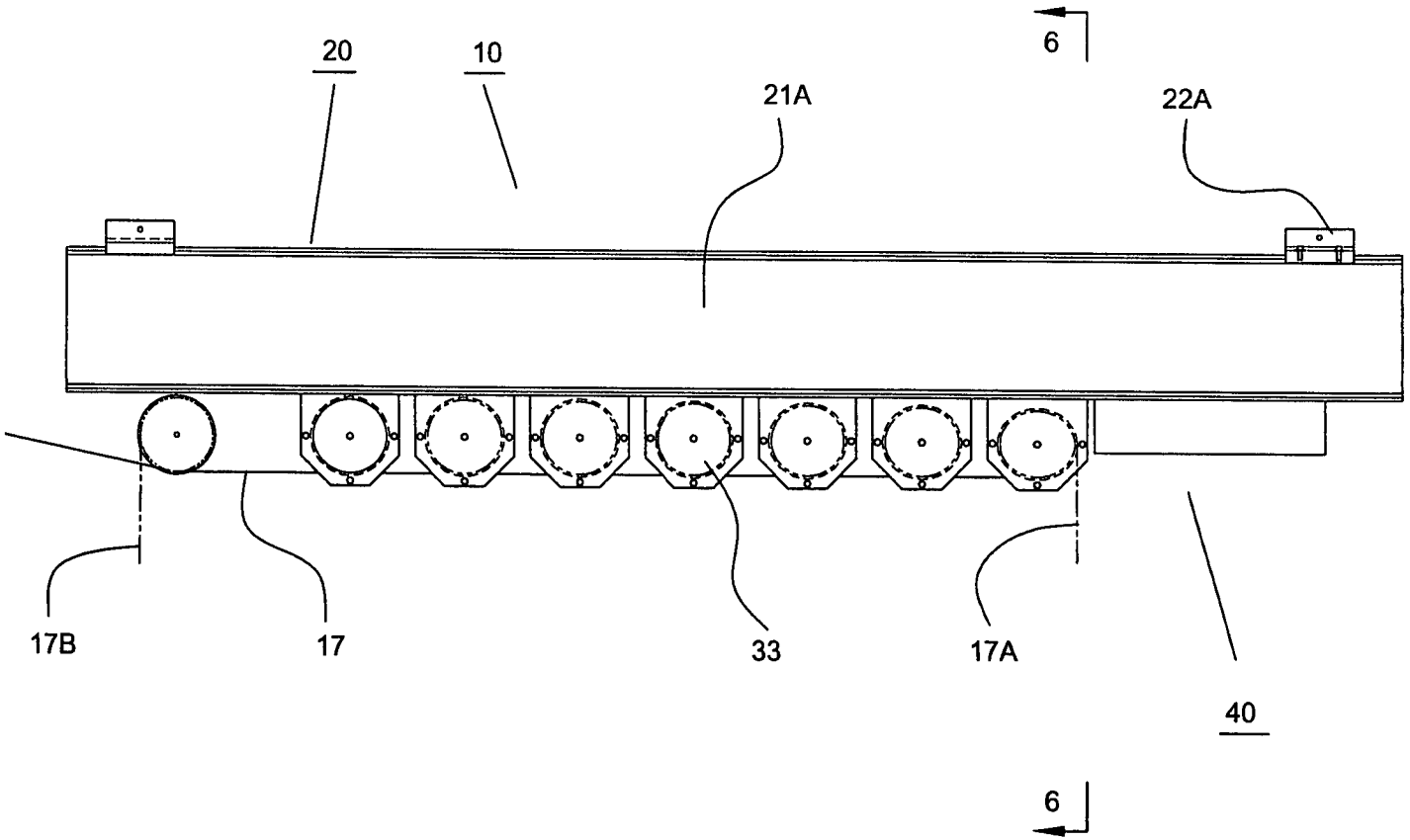
FIG. 5 is a side view of an improved winch in accordance with the invention, shown in another configuration, with the improved winch ready for mounting to a facility structure, showing alternate arrangement of sheaves and alternate mounting brackets.

The other type mounting bracket 22A, made of aluminum extrusion, is shown on FIG. 5 and FIG. 6. This bracket 22A engages the horizontal grooves at the sides and near the top of the tubular support enclosure 21A. Other than the geometry, its functionality is identical to the bracket described for FIGS. 1 and 2.

One configuration of the sheave assembly 30 is shown on FIG. 1 and FIG. 2. In this configuration the cable guiding sheaves 313 are mounted into a common enclosing housing 31 in vertically ascending fashion so as to provide vertical clearance between cables 17 leaving the cable guiding sheaves 313. The assembly 30 comprises outer side plate 311, inner side plate 312, sheaves 313, sheave shafts 314 and cable guards 315. The outer side plate 311 and the inner side plate 312 are fastened to the bottom side of the tubular support enclosure 21. The outer side plate 311 may be permanently fastened to the tubular support enclosure 21 by riveting, welding or bolting. One important feature of this invention is that the inner side plate 312 is removable and when removed, as shown on FIG. 7, access is provided to the winch unit 10 drum grooved portion 111 through the access openings 214 in the bottom side of tubular support enclosure 21 for removal and replacement and connecting the cables 17 to drum grooved portion 111.

Looking again at FIG. 1 and FIG. 2, the cable guiding sheaves are mounted on shafts 314, which shafts are permanently connected to the outer side plate 311 and connected through removable nuts 316 to the inner side plate 312. This unique arrangement of the invention permits removal of the inner side plate 312 while the cable guiding sheaves 313 can remain in place supported by the outer side plate 311 only. This is an important feature for removal and installation of cables 17 to drum grooved portion 111.

The cable guards 315 are used to prevent the cables 17 from leaving the grooves of sheaves 313. The cable guards 315 may also be used to tie the sheave assembly 30 side plates 311 and 312 together for additional rigidity. They can also prevent a cable guiding sheave 313 from falling out of the sheave assembly 30 in case of the sheave shaft 314 failure. The cable guards 315 are bolted to the inner side plate 312 and to the outer side plate 311. When the inner side plate 312 is removed, the bolts can be disconnected from the outer side plate 311 only, so that the cable guards 315 are removed together with the inner ride plate 312. This permits access to the grooves of sheaves 313 for replacement of cables 17, which may have pre-installed fittings (not shown) that would not fit through the sheave 312 groove when the cable guard 315 is in place. This arrangement also permits the removal of a cable guard if a straight cable drop 17A is required as shown on FIG. 1. The side plates 311 and 312 can be made of aluminum or steel. Preferred material for the sheaves is nylon.

A second configuration of sheaves is shown on FIG. 5 and FIG. 6. This configuration consists of individual sheave assemblies 33 each mounted to the bottom side of tubular support enclosure 21A. Each sheave assembly 33 consists of housing 331 and sheave 313. As shown on FIG. 6, each sheave assembly 33 has a different angular orientation with respect to the bottom surface of tubular support enclosure 21. This separates the cables 17 horizontally from each other. For removal and replacement each cable 17 the respective sheave assembly 33 has to be removed in order to provide access to drum grooved portion 111 through the opening 214. A sheave assembly 33 can also be removed if a straight cable 17A drop from drum grooved portion 111 is required as shown on FIG. 1.

Figure 1A:
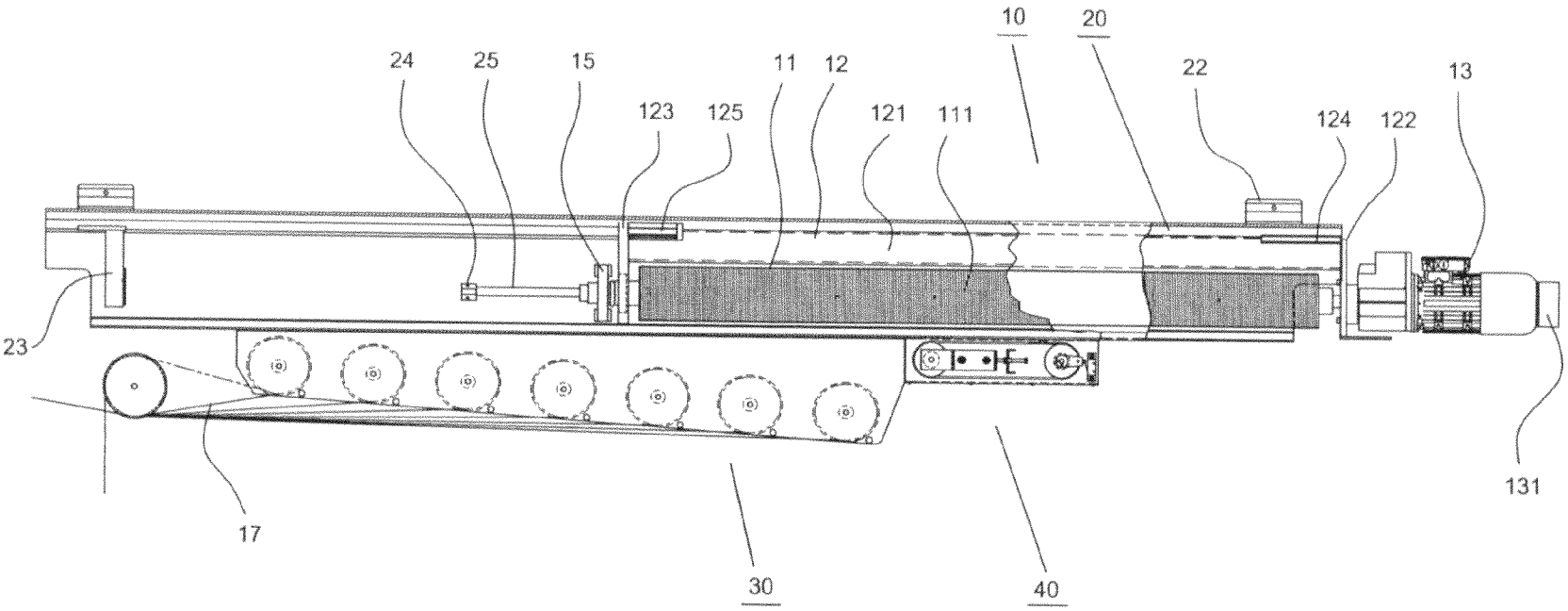
FIG. 1A is a side view of an improved winch, shown in FIG. 1, showing the motor and gear drive withdrawn from the enclosure for servicing without affecting the integrity of the enclosure mounting to the facility.
Figure 1B:
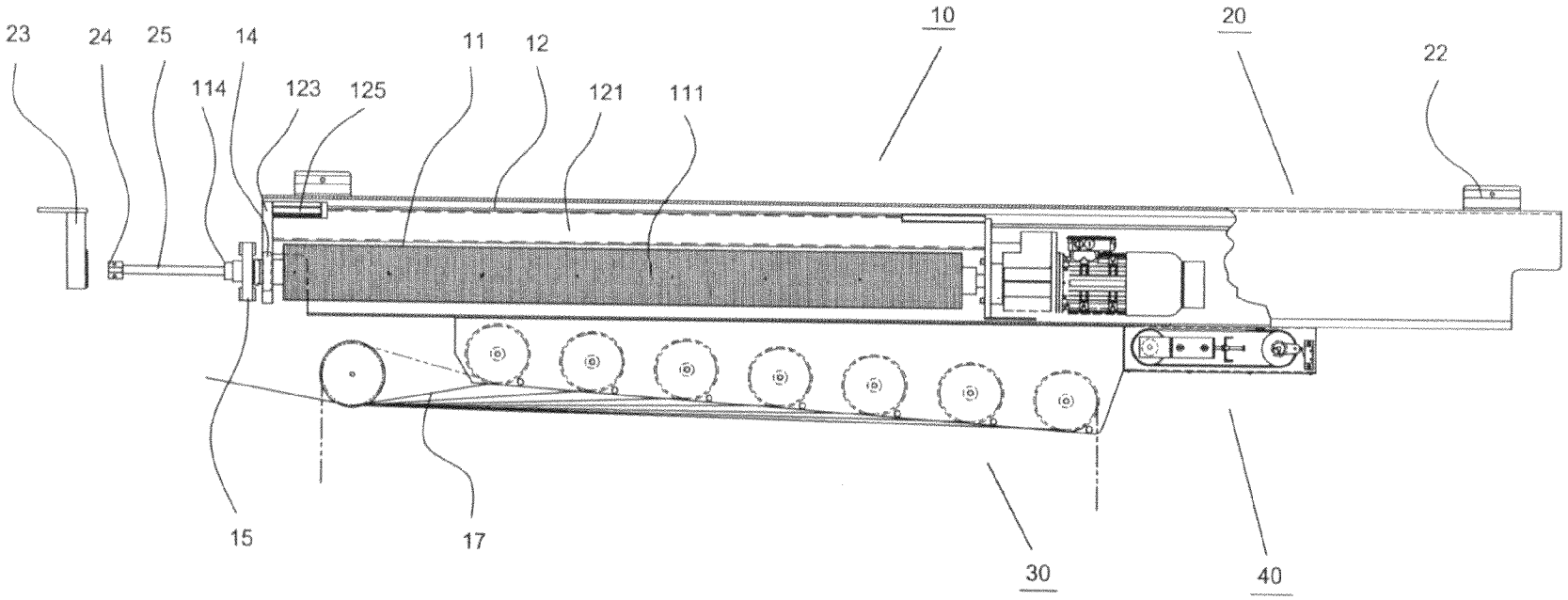
FIG. 1B is a side view of an improved winch, shown in FIG. 1, with the overspeed brake and bearing end of the winch unit withdrawn from the enclosure for servicing without affecting the integrity of the enclosure mounting to the facility.

According to a feature of the invention (FIG. 1, 1A, and FIG. 2) access for maintenance or removal and replacement of the motorized gear reducer 13 is provided by disconnecting the power transmission screw connector 24 from the support 23 at the left of FIG. 1 and sliding the winch unit 10 on bearings 127 to the right so that the motorized gear reducer is moved outside, and past the end of the tubular support enclosure 21, all while the motor end support 124 remains engaged and supported by the tubular support enclosure 21 support and guide grooves 211. For this purpose, the right end of the enclosure may be left open as shown or provided with a removable cover. According to FIG. 1B the access for maintenance or removal of the overspeed brake 15, bearing 14, power transmission nut 114, power transmission screw 25 and screw connector 24 is provided by disconnecting the screw connector 24 from the support 23, then by disconnecting and removal of the support 23 and by sliding the winch unit 10 to the left so that the overspeed brake 15 and the selected components are outside and past the brake end of the tubular support enclosure 21, again while the brake end support 125 remains engaged and supported by the tubular support enclosure support and guide grooves 211. Similarly, the left end of the enclosure may be left open as shown or provided with a removable cover.

Referring now to FIG. 7, the access for removal of the cables 17 from the drum grooved portion 111, and their replacement, is provided through the access openings 214 on the bottom side of tubular support enclosure 21 after removal of the sheave assembly inner side plate 312.

Figure 8:
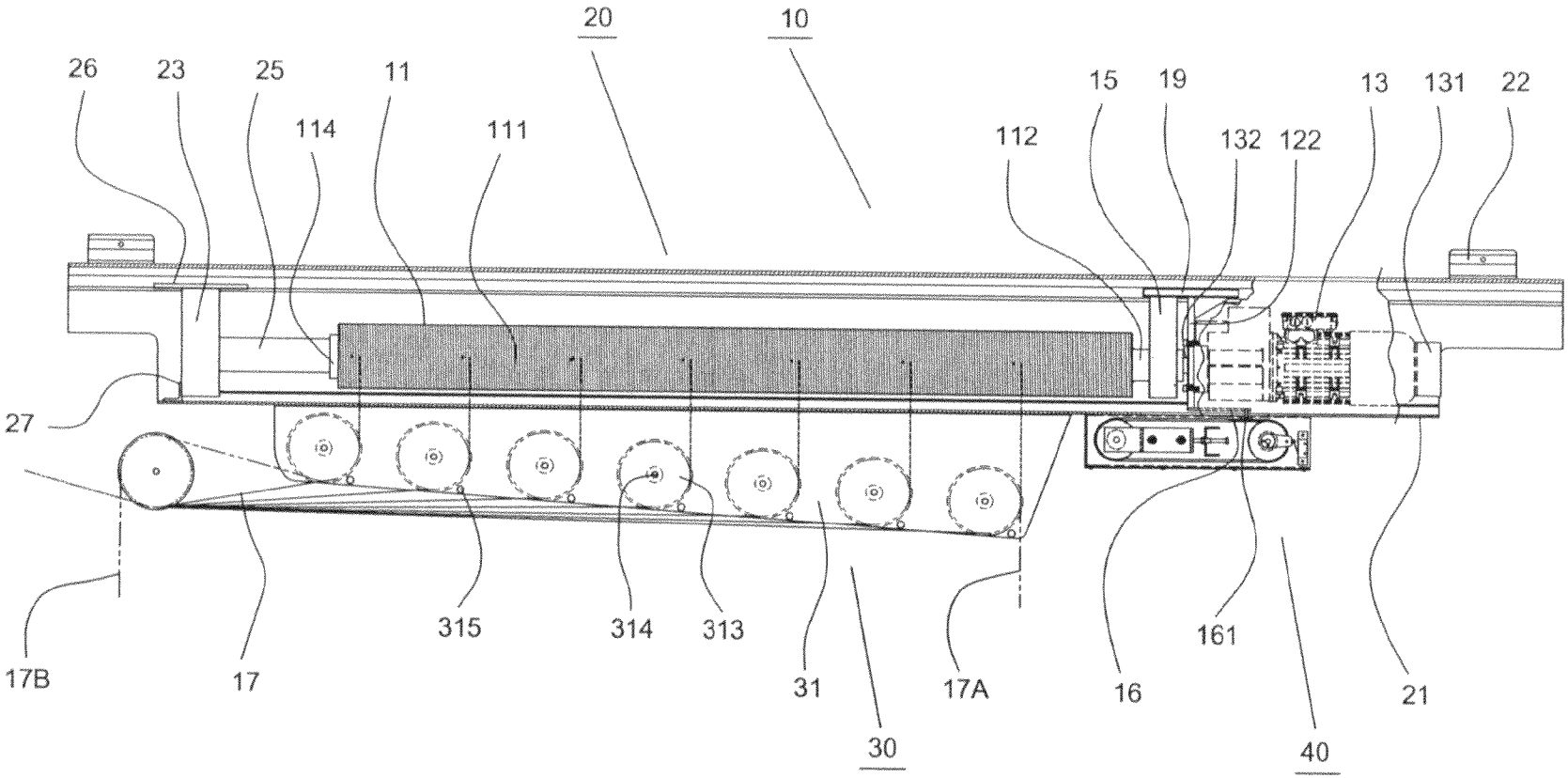
FIG. 8 is a side view of an improved winch in accordance with the invention shown in another configuration with the improved winch ready for mounting to a facility structure. The tubular support structure is partially cut to show the winch unit inside.

FIG. 8 illustrates another configuration of the improved winch. This winch 10 includes a drum assembly 11, rotatably supported and directly driven at its drive end through motorized gear reducer 13 mounted on a sliding or rolling base 19. The sliding or rolling base 19 consists of a motor end member 122 and sliding guide 124, rigidly connected to each other so as to slidably or rollably support the motorized gear reducer from the tubular support enclosure 21 by guide grooves 211 (FIG. 3) through sliding or rolling bearings (not shown) and transfer the motorized gear reducer 13 drive torque into the tubular support enclosure 21. The opposite end of a cable drum assembly 11 is supported from a power transmission screw 25 (ACME, ball or roller type), connected rigidly and non-rotatably to the screw support 23 inside the tubular support enclosure 21 so that all the forces imposed by the cable drum assembly 11 are transferred through the power transmission screw 25 and the screw support 23 into tubular support enclosure 21.

The drive end of the drum assembly 11 has an elongated hub 112 at its motor end. The motor end hub 112 engages the motorized gear reducer 13 shaft 132 that supports and rotates the drum assembly 11. An overspeed brake 15 is also mounted to the sliding or rolling base 19. The overspeed brake 15 engages the motor end hub 112 in case of motorized gear reducer 13 or the gear reducer shaft 132 failure. The overspeed brake 15 stops the rotation of drum assembly 11 and supports the lifted load hung from cables 17.

In the configuration shown in FIG. 8, the drum assembly 11 is used for horizontally moving the drum assembly 11 and motorized gear reducer 13 together with sliding or rolling base 19 inside the tubular support enclosure 21 in relation to the cable guiding sheaves 313. The movement is fixed in synchronization with the cable 17 back and forth travel in the drum assembly 11 grooved portion 111 grooves. This is accomplished by a power transmission screw 25, which is connected non-rotatably to the screw support 23 inside the tubular support enclosure 21. A matching power transmission screw nut 114 is mounted to the drum assembly 11, which is hollow so that the drum assembly 11 can move over the power transmission screw 25 when the drum assembly 11 translates in its longitudinal direction when it rotates.

The nut 114 being secured to drum assembly 11 rotates together with the drum assembly 11 and also with respect to power transmission screw 25. The pitch of the power transmission screw 25 thread is equal to the pitch of the drum assembly 11 grooved portion 111 cable grooves. Therefore, the drum assembly 11, together with the sliding or rolling base 19 and motorized gear reducer 13 are moved in synchronization with the back and forth travels of cables 17 in drum assembly 11 grooved portion 111 grooves. Straight cable paths are maintained between the drum assembly 11 and cable guiding sheaves 313.

Another option is to mount the power transmission screw 25 rigidly to the end of the drum assembly 11 and to mount the power transmission nut 114 rigidly to the screw support 23. Now the power transmission screw 25 would rotate together with drum assembly, engage the fixed power transmission nut 114 and translate the drum assembly 11 together with the sliding base 19 in synchronization with the back and forth travel of cables 17 in drum assembly 11 grooved portion 111 grooves.

Other features of the configuration illustrated in FIG. 8 remain similar to those described for the preferred embodiment for FIG. 1 and in the figures referred to in FIG. 1.

Figure 8A:
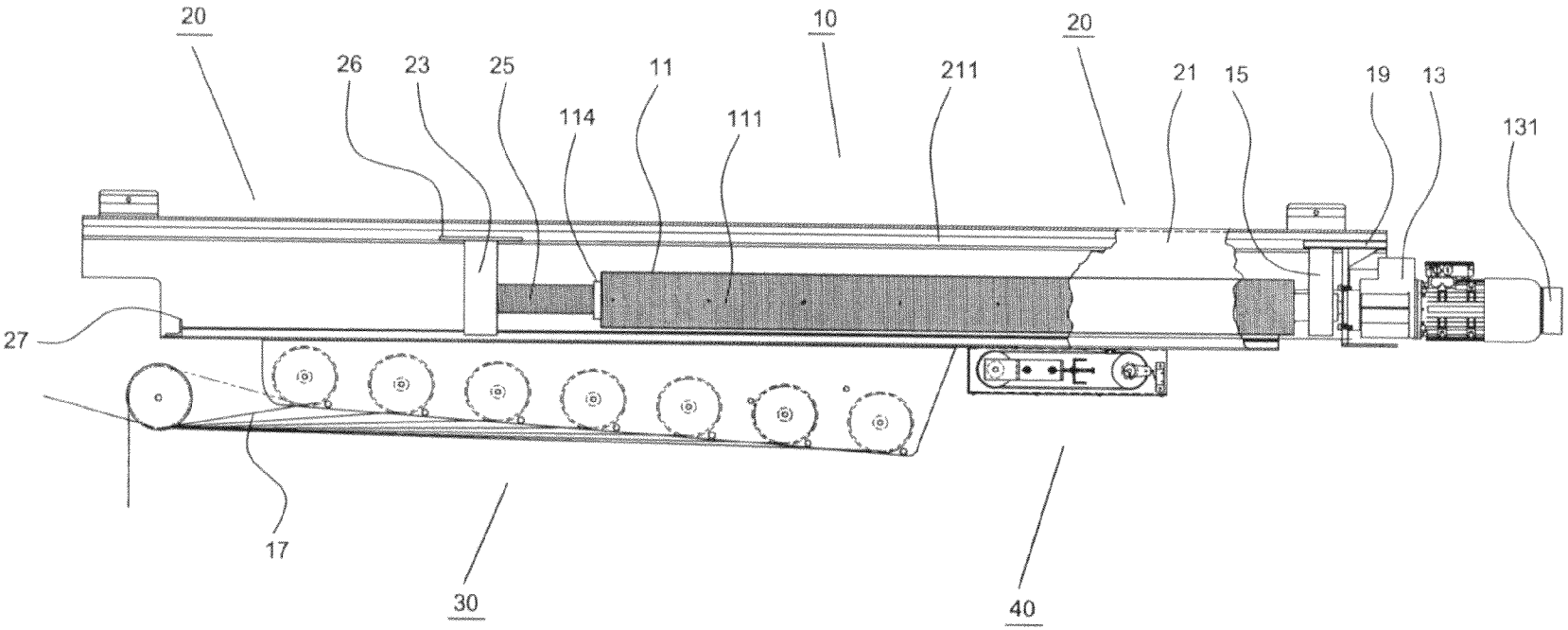
FIG. 8A is a side view of an improved winch, shown in FIG. 8, with the motorized gear reducer and overspeed brake exposed for maintenance. The tubular support enclosure is partially cut to show the winch unit inside.

According to FIG. 8A the access for maintenance or removal and replacement of the motorized gear reducer 13, overspeed brake 15 and other components mounted at or near the motorized gear reducer 13 is provided by disconnecting the support 23 top plate 26 from the tubular support enclosure 21 support and guide groove 211 and from the angle 27 (if used). The entire winch unit 10 can now be moved while supported by tubular support enclosure 21 guide and support grooves 211 to a position where all the motor end components are outside the tubular support enclosure 21 and accessible for maintenance.

Figure 9:
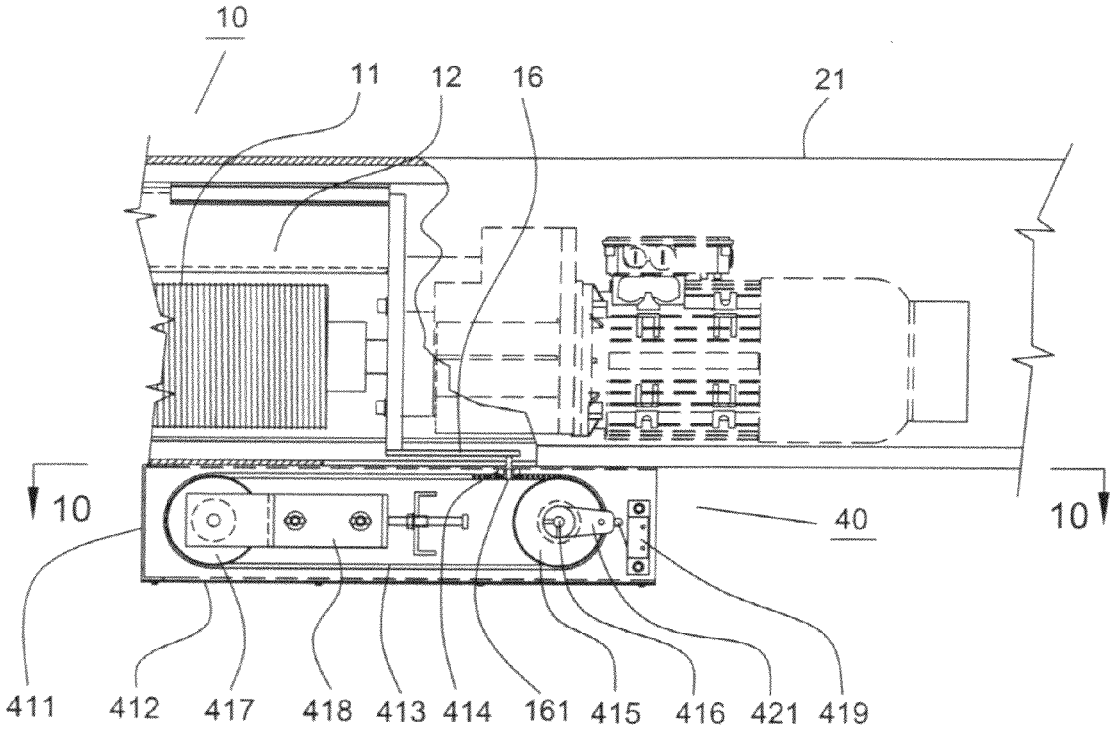
FIG. 9 is a partial cross section of the control sensor assembly and winch unit illustrating one configuration of control sensor and its connecting linkage to the winch unit.
Figure 10:
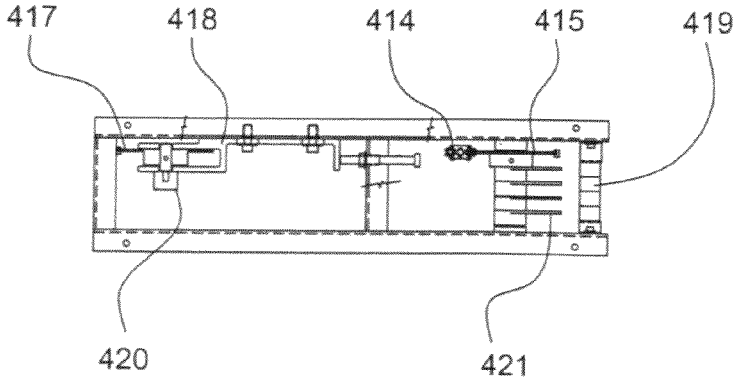
FIG. 10 is a cross sectional view of the control sensor assembly taken along line 10-10 of FIG. 9.

FIG. 9 and FIG. 10 illustrate one configuration of the control sensor assembly 40 in the enclosure 411 with cover 412, mounted on the bottom side of tubular support enclosure 21. The assembly consists of a roller chain, or timing belt, 413 forming a continuous loop around a drive sprocket 415 and a tensioning idler sprocket 417 through a chain connector 414. Sprocket 417 is mounted into the enclosure 411 through a mount 418, which permits sprocket 417 position adjustment as required for chain 413 tensioning. The chain connector is linked to the winch frame through a bracket 16, part of winch frame 12 and through a sensor connecting pin 161. The pin 161 can float vertically inside the chain connector 414 so as not to affect the sprocket 415 angular positioning when there is vertical movement between the pin 161 and chain connector 414.

The back and forth movement of the winch unit 10 as the cables wind and unwind will move the chain 413 through equal distance and rotate the sprocket 415 and 417. The diameter of sprocket 415 is selected so that it would rotate somewhat less than one turn during the maximum horizontal travel of the winch unit 10. Rotation of the sprocket 415 also rotates the shaft 416 together with the cams 421 and encoder 420. The cams 420 are mounted on shaft 416 through means to permit their individual rotational position adjustment with respect to the shaft 416 and with respect to each other so that their ridges would actuate their respective limit switches 419 at the required winch terminal travel positions. For a theater fly winch one limit switch is normally used for the up travel terminal position, one for up over-travel position, one for down terminal travel position and one for the down over-travel position. The stopping at all intermediate travel positions, which may be programmed as required for a particular performance, is controlled by the encoder 420 mounted on the bracket 418 and also rotated by a shaft, part of sprocket 417.

As seen from FIGS. 13, 14, 15, 16, showing the installation of the winches 10 into a theater facility, with the sheave assembly above or below the enclosure, the control sensor assembly 40 is always accessible for maintenance and adjustments. This is one major advantage of the configuration and mounting location of the control sensor assembly 40 described under FIG. 9 and FIG. 10. The other advantage is that a single turn absolute encoder 420 can be used which is less costly than multi-turn absolute encoders.

Looking at FIG. 1, the control sensors (not shown) could also be mounted inside the tubular support enclosure 21 on the brake end memeber 123 in the space above the power transmission screw 25. In this case, they would be driven by the rotation of hub 113 through a roller chain (not shown) and a roller chain sprocket (not shown) mounted on the sensors. Since the drum assembly 11 rotates approximately through 40 turns for full travel in a typical installation, an additional gear reducer (not shown) would be required for reducing the limit switch cams rotation to one turn.

Figure 11:
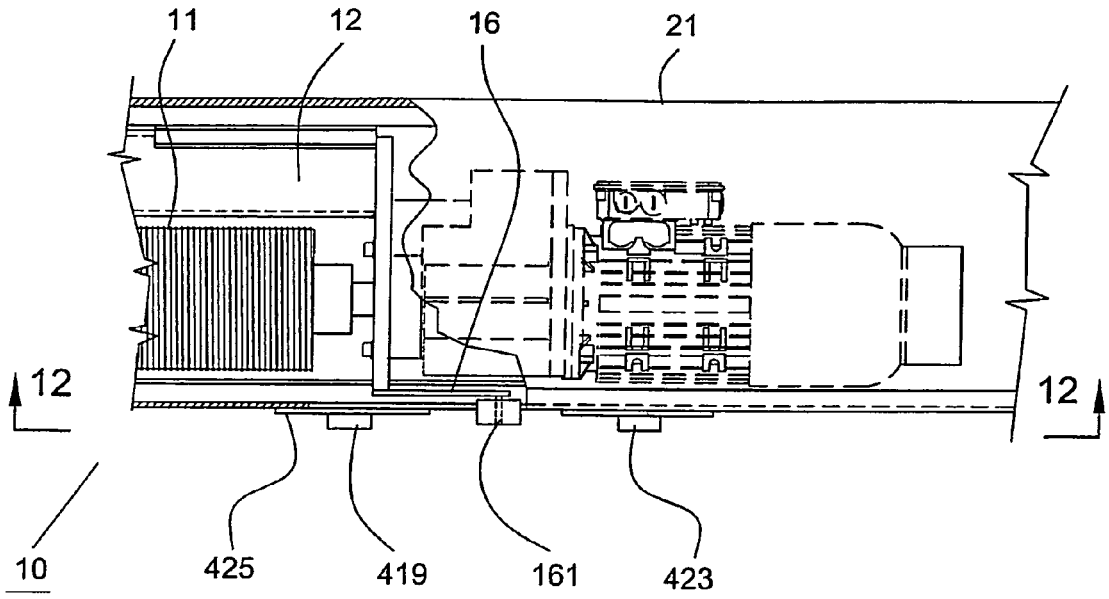
FIG. 11 is another partial cross sectional view of the control sensor arrangement and winch unit illustrating a configuration of limit switches directly activated by the winch unit back and forth movement through its control linkage.
Figure 12:
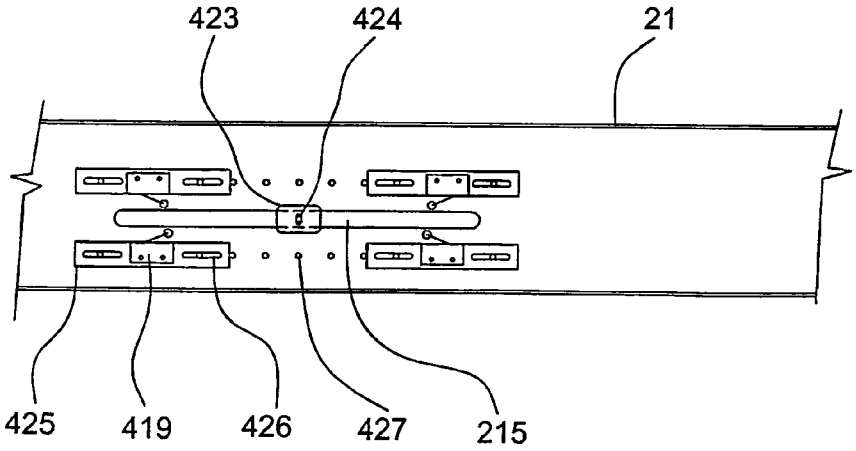
FIG. 12 is a cross sectional view of the limit switch mounting taken along line 12-12 of FIG. 11.

FIG. 11 and FIG. 12 illustrate another configuration of the limit switch mounting on the bottom side of tubular support enclosure 21. In this configuration a limit switch actuator slide 423 is mounted into the slot 215 cut through the bottom side of tubular support enclosure 21 and is guided by this slot. The limit switch actuator slide 423 is connected to the winch unit frame 12 through the bracket 16 and pin 161, which engages the hole 424 in the switch actuator slide 423. The hole 424 is slotted, perpendicular to the actuator slide 423 travel in the slot 215. This permits pin 161 vertical and lateral movement in the limit switch actuator slide 423 slotted hole 424 so that no vertical or lateral movements and forces are transferred from the pin 161 to the actuator slide 423 during the back and forth travel of the winch unit 10, which may slightly wobble during its back and forth travel due to the guide surfaces tolerance variations. The limit switches 419 are mounted near the ends of the limit switch actuator slide 423 travel to stop the winch at the up and down terminal positions and at the up and down over-travel positions when the limit switch actuator slide 423 strikes the limit switch 419 actuator arm. The limit switches 419 are mounted on sliding bases 425, which have slotted holes 426 for their position adjustment. For assisting precise limit switch 419 position adjustment, additional means, such as precision screw adjustment (not shown) can be used. For major changes of up and down stopping positions, the limit switches 419 together with their sliceable bases 425 can be mounted into different holes 427 at the bottom of the tubular support enclosure 21.

FIG. 11 and FIG. 12 do not show the encoder mounting or its driving method. For this limit switch arrangement a string actuated encoder (not shown) can be used with the string pulled by winch unit 10. Looking at FIG. 1, another option would be to mount the encoder (not shown) on the motor 13 or inside the tubular support enclosure 25 in the space above the power transmission screw 25. The encoder would be driven by rotation of hub 113 through roller chain transmission (not shown) installed between the hub and a second sprocket mounted on the sensors (not shown).

Figure 13:
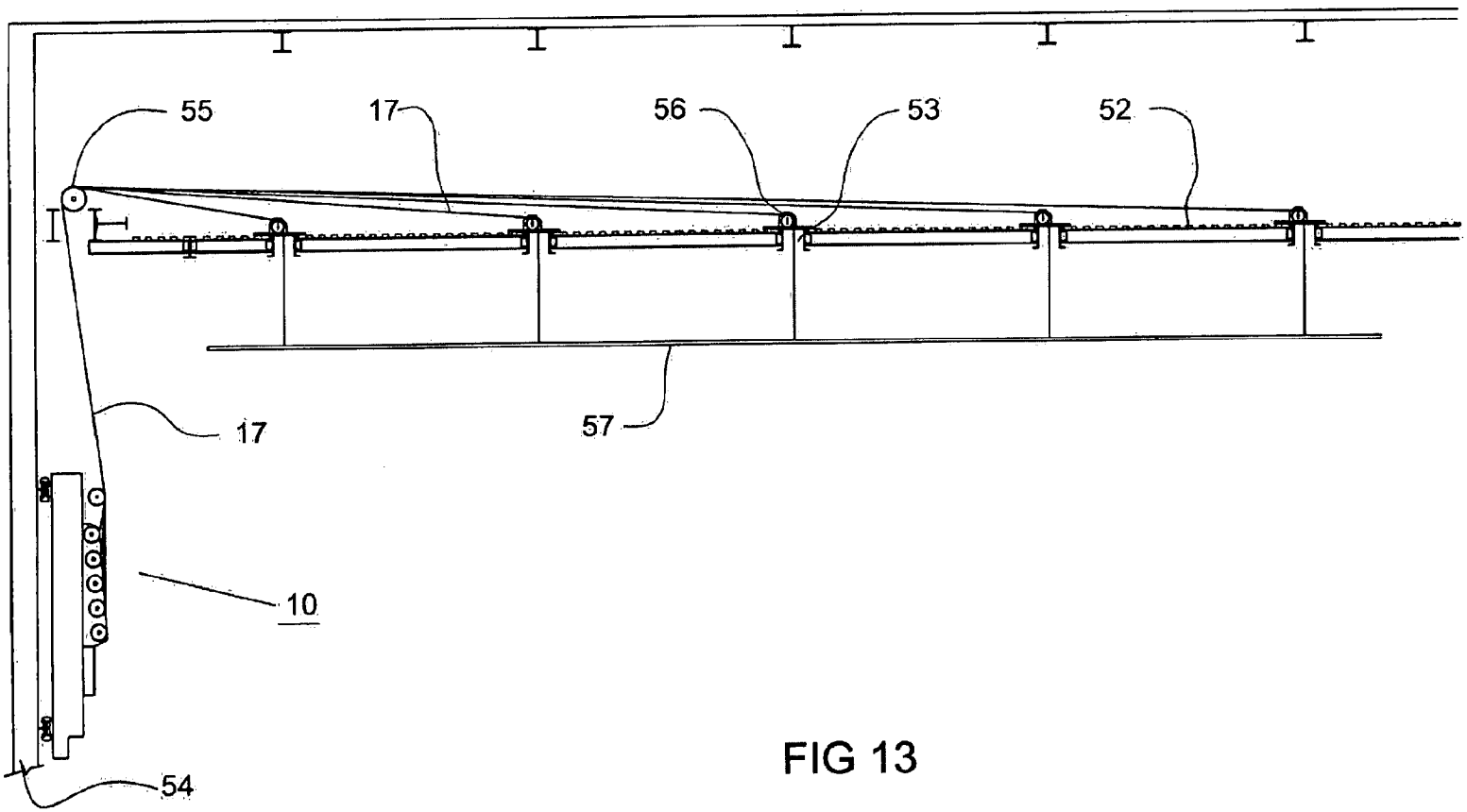
FIG. 13 is a side view of a stage, gridiron and fly set with the improved winches mounted on the stage sidewall.

FIG. 13 shows one installation in the facility where the improved winch 10 is installed on the stage sidewall 54 in vertical position. The cables 17 pass from the winch over the head block 55, over the loft blocks 56 and down to the pipe batten 57. This option of installation is particularly beneficial in existing theaters where the manually operated fly sets are replaced with motorized winches which, in this case, can be mounted on the wall that is used for the manual fly set counterweights and counterweight guides. Likewise, the existing head blocks 55 and loft blocks 56 will remain usable. Another reason why the improved winch 10 is particularly suitable for refurbishing the existing theaters in this manner is that winches 10 can be mounted adjacent to each other, as shown on FIG. 7 spaced at 8 inch centers, which is the generally accepted spacing for the motorized fly sets. The existing cables 17 can also be re-used, disconnected from the counterweights (not shown) and re-connected to the improved winch 10 cable drum assembly 11.

Figure 14:
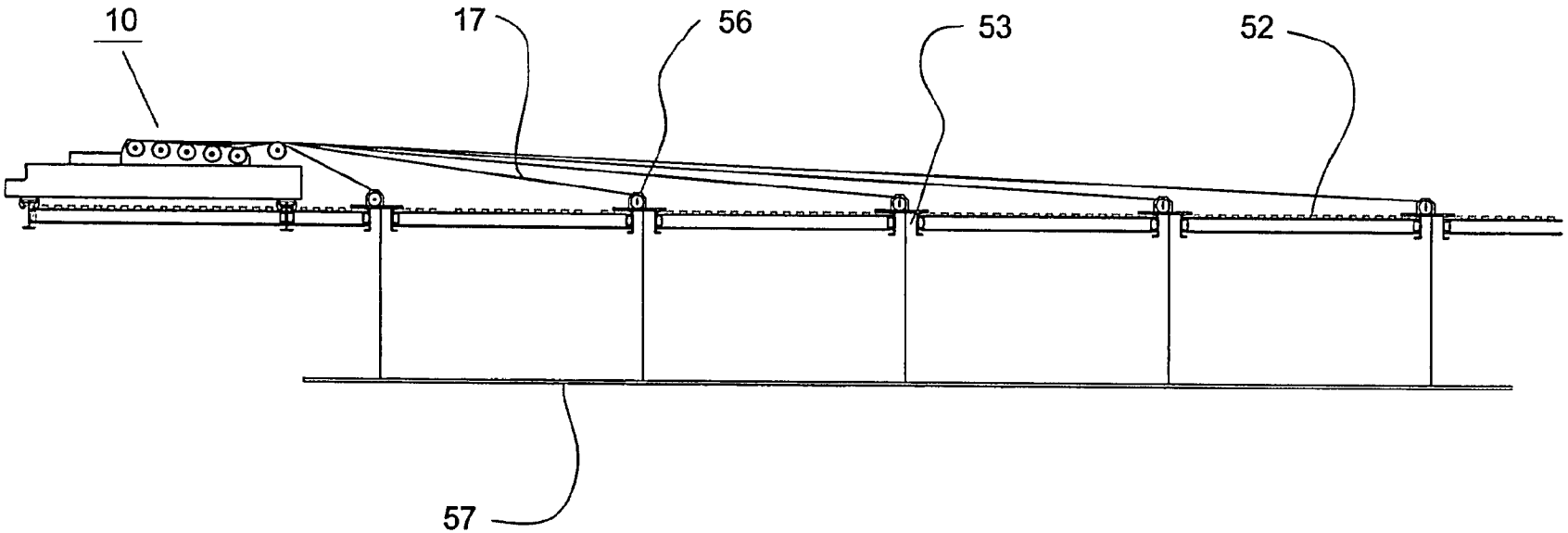
FIG. 14 is a side view of a gridiron and fly set with the improved winch mounted on the gridiron.

FIG. 14 shows another type of installation of the improved winches 10 into a facility. The improved winches 10 are installed at the gridiron 52 level at one or both (not shown) sides of the stage. The cables 17 pass from the improved winch 10 directly over the loft blocks 56 (mounted on the grid wells 53) down to the pipe batten 57. Note that this type installation in the new theaters eliminates the need for head blocks 55 shown on FIG. 13. It has also the advantages described under FIG. 13 for refurbishing the existing theaters.

Figure 15:
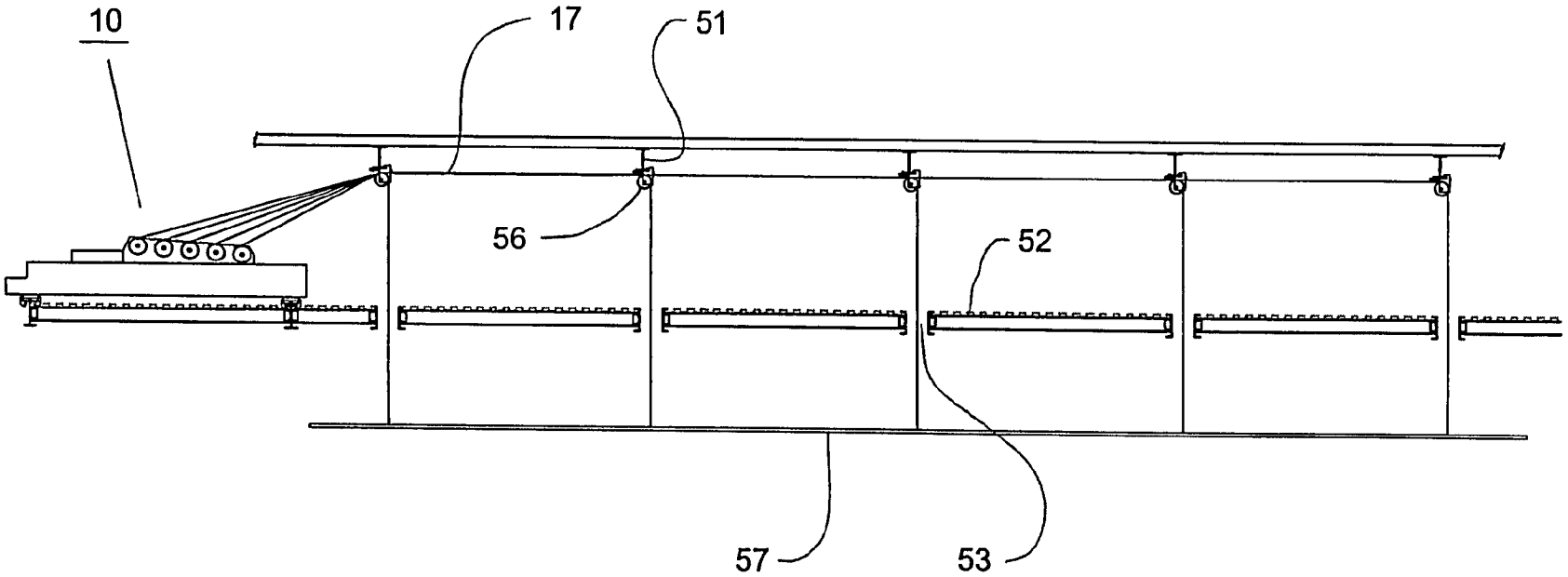
FIG. 15 is a side view with the improved winch mounted on the gridiron with loft blocks underhung from overhead roof or ceiling beams.

FIG. 15 shows a type of installation where the winches 10 are mounted on the gridiron at one or both sides (not shown) of the stage and the loft blocks 56 are mounted to the underside of the roof or ceiling beams 51, which are located above the gridiron wells 53. The cables 17 pass from the winch 10 directly over the loft blocks 56 and down through the grid wells 53 to the pipe batten 53.

Figure 16:
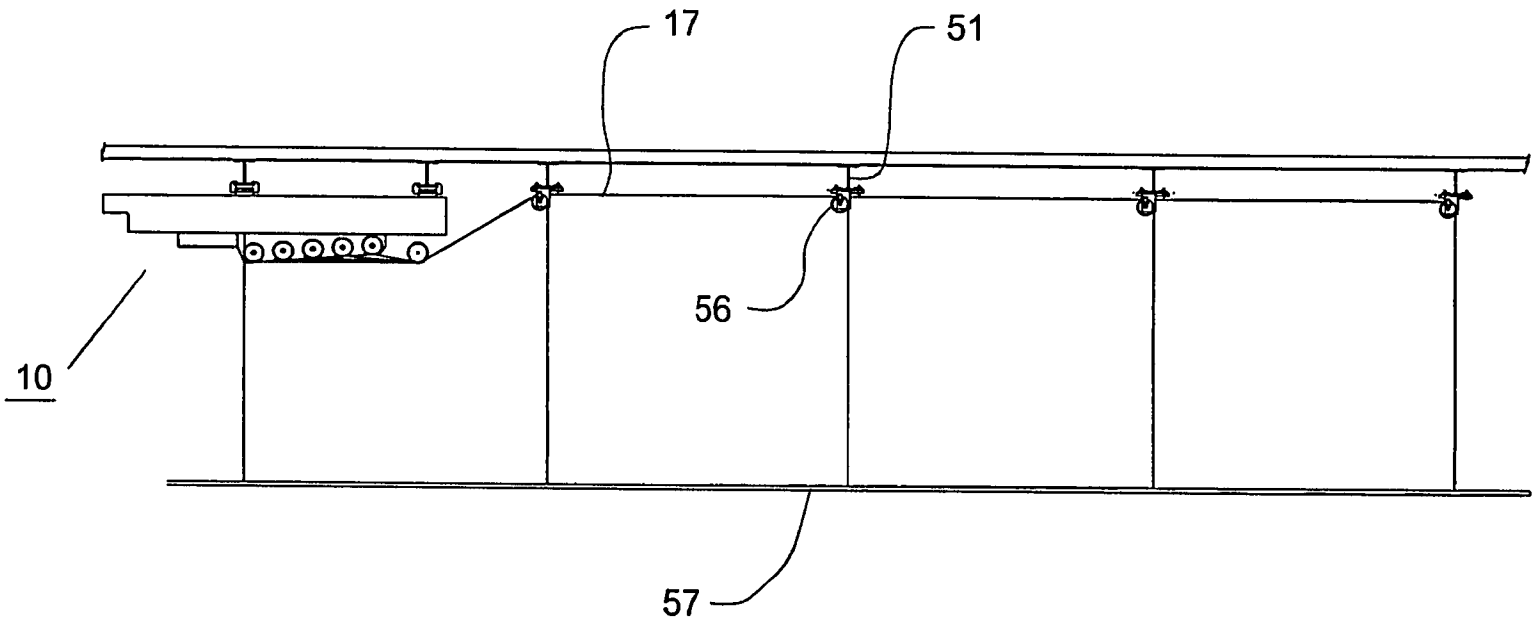
FIG. 16 is a side view of an underhung fly system from the facility structure with the improved winch underhung from the overhead beams.

FIG. 16 shows yet another type installation in a different facility where the improved winches 10 are under hung from the stage house overhead beams 51 and installed between the these beams 51. One cable 17 can be dropped directly from the improved winch 10 to the pipe batten 57 while the other cables 17 pass over the loft blocks 56 installed and connected to the stage house overhead beams 51. This type of installation is particularly useful for many small theaters, which do not have gridirons. It can be also used in the theaters with gridiron in order to keep the gridiron clear from horizontal cable 17 runs shown on FIG. 14. Instead of installing the improved winches 10 over the stage area as shown on FIG. 15, they can be mounted at the stage left or right areas and all cables 17 would then pass over the loft blocks 56 to the pipe batten 57. As another option, where the spacing of cables 17 along the length of pipe batten 57 is sufficiently close, (not shown), two cables 17 can be dropped directly from the improved winch 10 to the pipe batten 57.

Among the benefits of the invention over the previously built winches is the use of the tubular support enclosure, as a single structural member that performs a multitude of functions. It supports the winch unit mounted inside the tubular support enclosure, protects its movable parts, provides access for maintenance to the major movable parts, supports the cable guiding sheaves, and interfaces with the mounting brackets for installation of the improved winch to the facility structure. An advantage is that the tubular support enclosure can be produced as a one piece aluminum extrusion with all winch support ribs, guiding surfaces mounting bracket interfaces and other interface items formed as part of the extrusion. This minimizes the fabrication and assembly, requirements and reduces the cost.

Another important advantage is that the improved winches in this invention can be installed in a facility close to each other because the tubular support enclosure protects the moving parts of the adjacent winches from interfering with each other and all moving parts are confined within the volume previously defined. The desired 8-inch fly set spacing can be achieved with the improved winches installed in a single row, side by side, which is not possible with the currently available winches. This feature is especially beneficial for rehabilitation of the existing theaters, which use manually operated counterweight fly sets, where the improved winches can be installed to the wall that is used for guiding the counterweights. The improved winches would then be accessible for maintenance from the existing platforms used for loading the counterweights or from the stage floor.

In addition, the versatile improved winch can be installed in horizontal position on the gridiron level or above. It can be hung from the overhead beams above the gridiron or in the theaters which do not have gridirons. The improved winch can also be mounted in tilted positions where required. It can be mounted at either side of the stage or over the performing area. The protection provided to the critical moving components by the structurally sound tubular support enclosure simplifies the handling of the improved winch during its installation.

Yet another advantage of the invention is that easy access is provided for removal and replacement of the fly set cables through the openings in the mounted tubular support enclosure, which together with all the cable guiding sheaves are accessible when the inner side plate of the sheave housing is removed. This feature is also beneficial for rehabilitation of the existing theaters, which use manually operated counterweight fly sets. The existing loft blocks, head blocks, cables and pipe battens can be reused by simply disconnecting the cables from the counterweights and reconnecting them to the improved winches after installation of the winches.

The improved winch also improves personnel safety, because contrary to the currently available winches, with covers over their moving parts, which may be removed and left open, all the major moving parts of the improved winches are inside the tubular support enclosure, not accessible to the personnel during winch operation.

Additional safety is provided by mounting the overspeed brake to the opposite end of the drum from its drive end, so that in case of motor, motor brake, or the gear reducer of the drive shaft key failure, the overspeed brake would still stop the drum and support the objects hung from the winch. The tubular support enclosure would also contain the parts which may break off the winch unit in case of a catastrophic failure of the drive train and prevent them from falling.

It will also be appreciated that the invention is not limited to raising and lowering scenic elements in the theater, but can also be used in any facility with a need for raising and lowering any object, such as, for example, objects in a theme park.

The term "facility" has been used above to designate a building made up of the usual fixed structural members, such as beams, etc., and the tubular enclosure housing and supporting the winch unit typically is bolted at least at one end to a fixed structural member of the facility. However, while this is the more normal application of the invention, it is possible that in certain special cases the tubular enclosure housing and supporting the winch unit can be attached to a movable member in turn movably mounted to the facility. An example would be to mount the tubular enclosure housing and supporting the winch to a carriage riding on rails fixed to the facility to allow the load to be moved with the carriage or the carriage with winch to the location of the load. The inventive winch system is otherwise identical in this application, and thus "facility" should be interpreted to include not only fixed structural members of a building but also movable members connected to the building.

Descriptions of FIG. 1 and FIG. 2 teach that the sliding bearings 127 can be replaced with anti-friction ball or roller bearings or cam followers (hereinafter rollers). In this configuration these rollers (not shown) would be mounted to the frame 12 or to the motor and brake end supports 124 and 125 respectively. These rollers (not shown) would then roll on the tubular support enclosure 21 support and guide surfaces 212 shown on FIG. 2 and would replace the sliding bearings 127.

Figure 17:
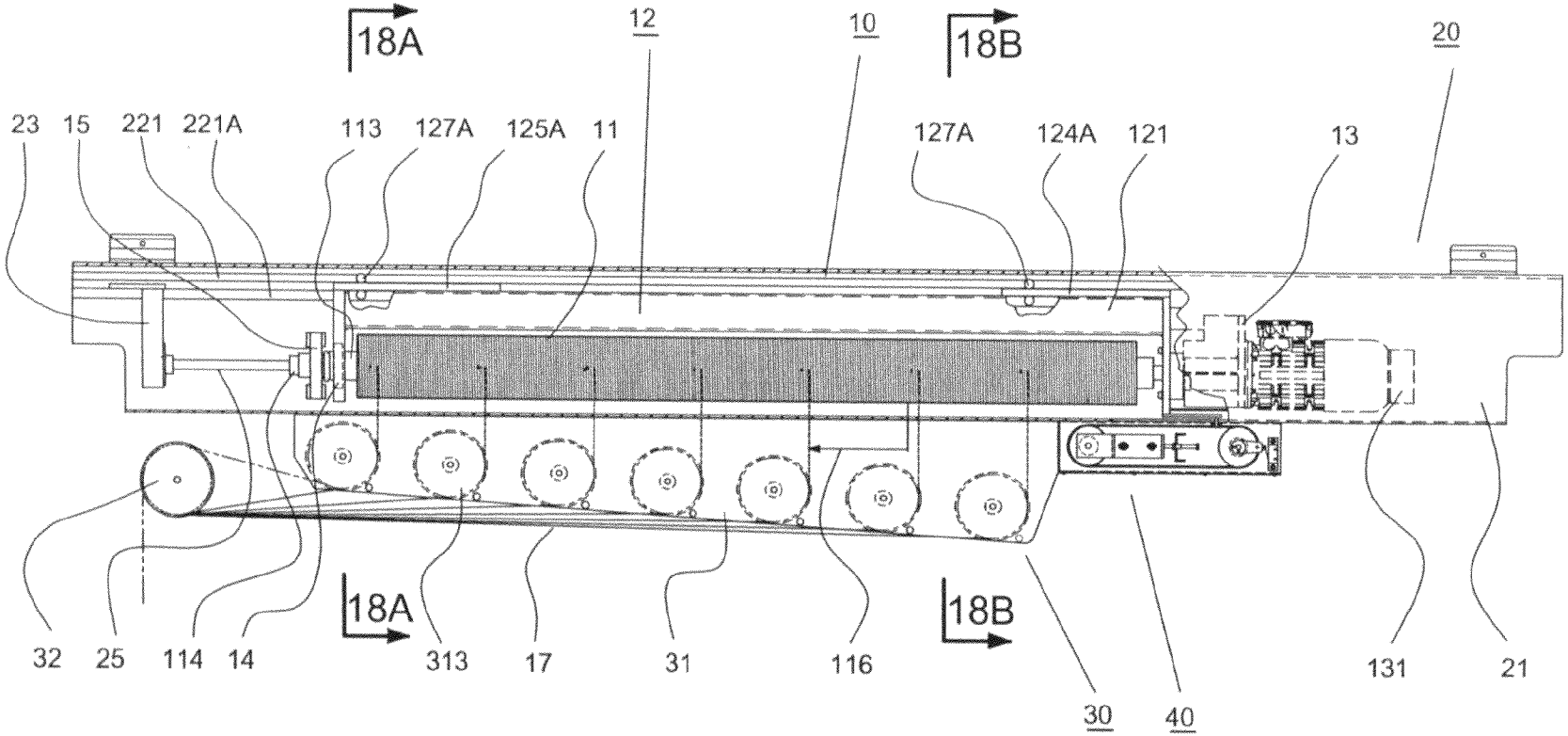
FIG. 17 is a side view of an improved winch in accordance with the invention shown in another configuration with the winch unit supported by rollers, instead of sliding bearings, with the improved winch ready for mounting to a facility structure. The tubular support enclosure is partially cut to show the winch unit inside and the rollers which are mounted to the inside of the tubular support enclosure.
Figure 18:
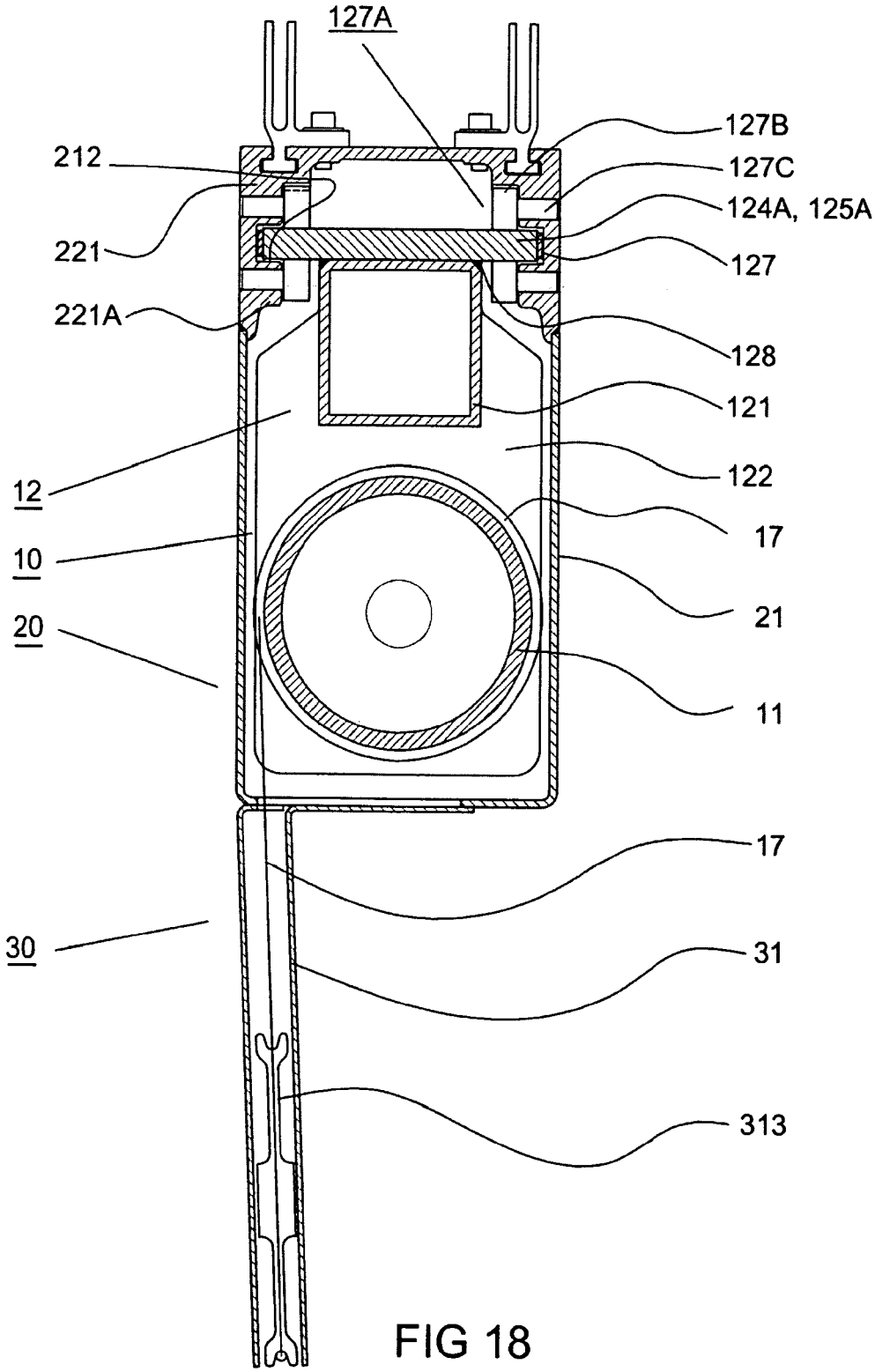
FIG. 18 is a cross sectional view of the improved winch taken along either lines 18A-18A and 18B-18B of FIG. 17, illustrating how the winch unit is supported by rollers mounted to the inside of the tubular support enclosure engaging, respectively the motor and brake end supports which supports are part of the winch unit.

This Continuation-in-Part application shows another option for replacement of sliding bearings 127 with rollers 127A, as shown on FIG. 17 and FIG. 18. In this configuration the modified winch remains identical to the winch shown on FIGS. 1 and 2, 3, 4, except the sliding bearings 127 and their supports 124, 125 shown on these FIGS. are replaced, as shown on FIGS. 17 and 18, with rollers 127A. Instead of mounting these rollers 127A on the winch unit 10, they are mounted to the inside of the tubular support enclosure 21.

Looking at FIGS. 1, 2 and 3, the sliding bearings 127 are mounted on the frame 12 motor end support 124 and brake end support 125 and translate horizontally with the winch unit 10 in the longitudinal direction of the tubular support enclosure 21 when the drum assembly 11 rotates. Looking at FIGS. 17 and 18, in contrast, the rollers 127A do not translate in the longitudinal direction with the winch unit 10, but remain fixed to the tubular support enclosure 21. In the example as shown, at each end of the system four rollers 127A, two on top and two on bottom, support the winch unit 10 in the vertical direction as shown on FIG. 18, a total of eight rollers in this example. These rollers engage the top and bottom surfaces of the motor end support 124A and brake end support 125A, which supports are part of the winch unit 10 and translate together with the winch unit 10 in the longitudinal direction of the tubular support enclosure 21 when the drum assembly 11 rotates. More rollers 127A can be used if required for supporting very heavy loads. Each roller 127A may be an assembly of an anti friction or sleeve bearing 127B, rotatably mounted on a shaft or stud 127C. The shafts 127C can be screwed into threaded holes in the enlarged ribs 221 and 221A, part of the tubular support enclosure 21, as shown, or they can be secured to the tubular support enclosure 21 by riveting, shrink fit or by other means. Each such roller assembly is commonly known as cam follower or track roller and are standard parts made by several manufacturers. Examples would be McGill CFH 1⅛ SB, RBC Bearings RBC 1⅛. There are many others available commercially.

FIG. 18 is a cross section taken, for example, at line 18A-18A or 18B-18B of FIG. 17. It shows a cross sectional profile of the tubular support enclosure 21 with longitudinal thickened portions or ribs 221 and 221A which are also shown on FIG. 17. These ribs 221 and 221A provide the required metal thickness for mounting the rollers 127A into the tubular support enclosure 21. During winch unit 10 normal operation, when the winch unit 10 is supported by rollers 127A bearing on the top and bottom surfaces of the motor and brake end supports 124A and 125A, the latter shown on FIGS. 17 and 18, do not touch the ribs 221 or 221A. However, as an additional function, the ribs 221 and 221A would support the winch unit 10 in case of a roller 127A failure. Another purpose of the ribs 221 and 221A is to provide support surfaces 212 for sliding the winch unit 10 motor or brake end out of the tubular support enclosure 21 in a manner shown on FIGS. 1A and 1B for maintenance.

The sliding bearings 127 (also known as sliders), shown here and also in the FIG. 1 embodiment, are mounted on the outside edges of the motor end support 124A as shown on FIG. 18 and to the outer edges of the brake end support 125A (not shown). All sliding bearings 127 translate together with the winch unit 10 and support the winch unit 10 in transverse direction, perpendicular to the tubular support enclosure 21, in a manner identical to the winch unit shown on FIGS. 1 and 2, 3, 4. As an alternate, the rollers 127A can be replaced with flanged rollers (not shown) for supporting the winch unit 10 from the tubular support enclosure 21 in its transverse direction. In this case the sliding bearings 127 can be eliminated.

The advantage of the improved winch configuration shown on FIGS. 17 and 18 is that the rollers 127A reduce considerably the friction between the tubular support enclosure 21 and the winch unit 10 as compared to the sliding bearings 127 shown on FIGS. 1 and 2, 3, 4. The rollers 127A, however, apply high force concentrations on the surfaces of the motor and brake end supports 124A and 125A. If the latter were of aluminum they would not have good-enough surface strength for the rollers 127A to roll on without possibly causing excessive wear under concentrated heavy loads. In order to resist these forces, without excessive wear, preferably the motor end support 124A and the brake end support 125A can be made of steel. These supports can be welded to the frame 12 by welds 128 as shown on FIG. 18 if the frame 12 or its horizontal member 121 is made of steel. If the frame 12 or its horizontal member is made of aluminum or from other materials, bolted, riveted or other type connection (not shown) should be used. The aluminum extrusion can still be used for the tubular support enclosure 21 and has adequate strength for mounting the rollers 127A to the inside of the tubular support enclosure 21. The rollers 127A on the top surfaces of the motor and brake end supports 124A and 125A are important because the tubular support enclosure 21 is subjected to twisting forces by the torque applied by the motorized gear reducer 13, shown on FIG. 17, when loads are hung from the drum assembly 11 by cables 17. The rollers on top assist in resisting such forces. Since, however these forces are lower than the forces on the bottom rollers, replacing the top rollers with sliding bearings (not shown) would not substantially increase the friction and can be beneficial.

Looking again at FIG. 17, the supports 124A and 125A translate together with the winch unit 10 in the longitudinal direction of the tubular support enclosure 21 when the drum assembly 11 rotates during lifting or lowering the loads (not shown) on cables 17. Therefore the supports 124A and 125A have to be slightly longer than the winch unit 10 maximum longitudinal translation 116 in order for the rollers 127A to remain engaged with the supports 124A and 125A.

The replacement of sliding bearings 127 on FIGS. 1, 2 and 3 with the rollers 127A shown in FIGS. 17 and 18 is described as a modification of the winch shown in FIGS. 1 through 7 and 9 through 16. Identical modifications are possible also for alternate winch embodiments as shown on FIGS. 8 and 8A.

Figure 19:
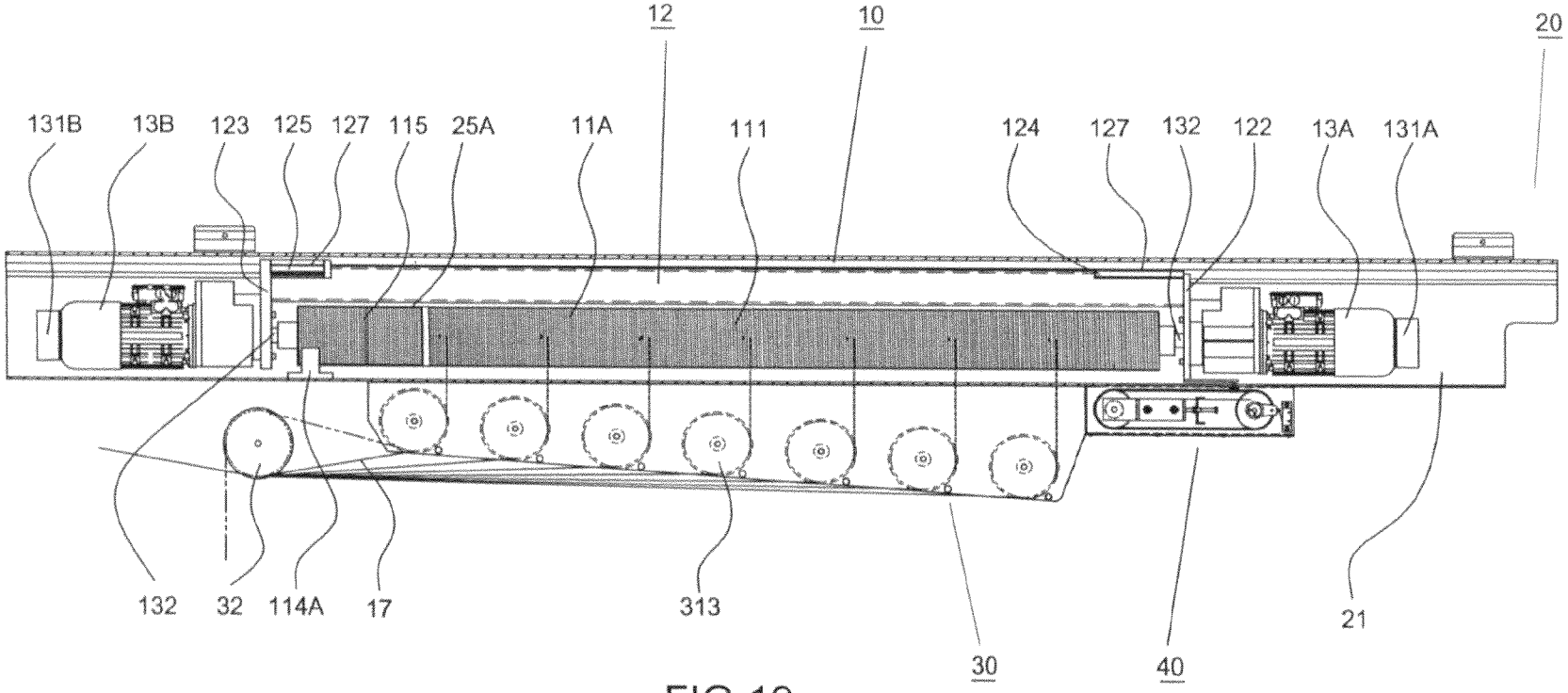
FIG. 19 is a side cross sectional view of an improved winch in accordance with the invention, shown in another configuration, where two motorized gear reducers are used to drive the drum for increased speed or increased load capacity of the winch, without making it wider than 8 inches.

FIG. 19 shows another embodiment of winch where two motorized gear reducers 13A and 13B, with brakes 131A and 131B, connected at opposite ends of the drum, are used for rotating the drum assembly 11A for lifting or lowering the loads on cables 17 and for translating the winch unit 10 in the longitudinal direction of the tubular support enclosure 21. Two motorized gear reducers permit increasing the hoisting speed or increasing the lifted weight, or both, without making the winch (tubular support enclosure 21) wider than 8 inches while still maintaining all fail safe features of the winch embodiments shown on FIGS. 1 through 16.

In the embodiment shown on FIG. 19 the tubular support enclosure 21, the frame 12, the motor end support 124, the brake end support 125, bearings (sliding) 127, the sheave assembly 30, the guide block 32 (shown on FIG. 1) and the control sensor assembly 40 function exactly as for the embodiment shown on FIGS. 1 through 7 and FIGS. 9 through 16.

The overspeed brake 15 shown on FIG. 1 can be removed and replaced on FIG. 19 with the second motorized gear reducer 13B. The torque ratings of the motorized gear reducers 13A and 13B and their brakes 131A and 131B are selected so that if one motorized gear reducer fails, the other can safely support the entire load suspended from cables 17 with adequate safety factor. Thus the fail safe feature, previously provided by the overspeed brake 15 on FIG. 1 is maintained.

Looking again at FIG. 1, the power transmission screw 25, the screw support 23 the power transmission nut 114 and the screw connector 24 are eliminated and these functions are performed by the drum assembly 11A shown on the FIG. 19 embodiment. This drum assembly 11A is extended. The cable wrapping portion of the drum assembly is grooved to match the diameters of cables 17. The drum assembly extended portion 115 has a power transmission thread 25A machined into its outer surface. A block 114A with matching thread is bolted to the tubular support enclosure 21 and engages the thread 25A of the drum assembly 11A extended portion 115. The pitch of the thread 25A is equal to the pitch of the drum assembly 11A cable grooves. Therefore, when the drum assembly 11A rotates, it translates in the longitudinal direction of the tubular support enclosure 21 together with all winch unit 10 components in synchronization with the back and forth wrapping of the cables 17 on the drum assembly 11A grooves (herein also "cable grooves"). Straight cable paths are maintained between the drum assembly 11A and sheaves 313.

As an alternate, the cable grooves in the drum assembly 11A grooved portion 111 can substitute the thread 25A in the drum extended portion 115 and a block 114A or rollers (not shown) can engage these cable grooves to translate the drum assembly 11A together with the winch unit 10 in the longitudinal direction of the tubular support enclosure 21 as described above. In this case the drum assembly extended portion 115 would be shortened or eliminated.

The drum assembly 11A can be mounted directly on the shafts 132 of one or both the motorized gear reducers 13A and 13B, or it can be supported by additional bearings (not shown) installed into one or both frame 12 motor and brake end members 122 and 123 respectively and connected to the motorized gear reducers through flexible couplings (not shown).

While the embodiment of the winch shown on FIG. 19 is described with sliding bearings 127 supporting the winch unit 10 from its tubular support enclosure 21, a modification with rollers 127A as shown on FIGS. 17 and 18 can be used.

Figure 20:
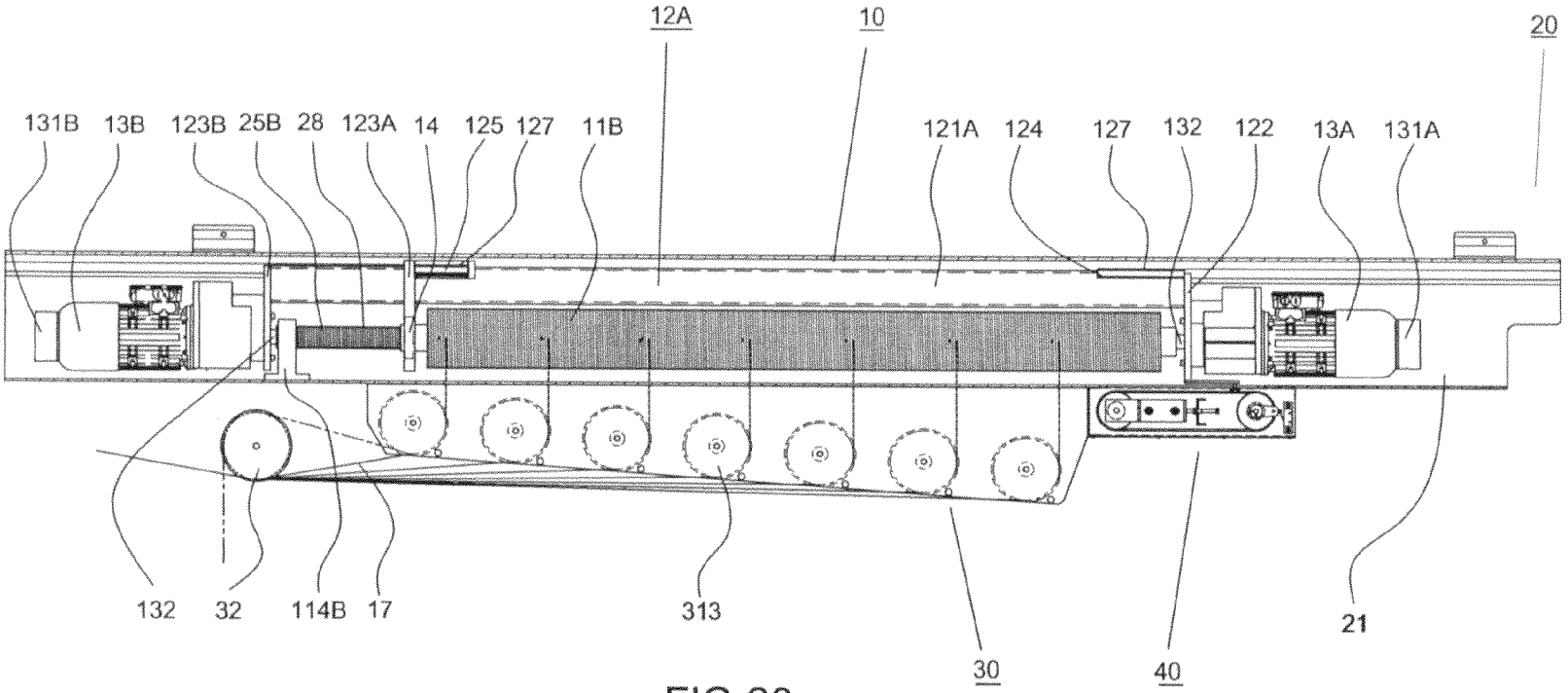
FIG. 20 is yet another cross sectional side view of an improved winch in accordance with the invention, shown in yet another different configuration, where two motorized gear reducers are used to drive the drum, through a connecting shaft, for increased speed or load capacity of the winch without making it wider than 8 inches.

FIG. 20 shows yet another embodiment of a winch where two motorized gear reducers 13A and 13B together with brakes 131A and 131B are used for rotating the drum assembly 11B for lifting and lowering loads on cables 17 and for simultaneously translating the winch unit 10 in the longitudinal direction of the tubular support enclosure 21. Two motorized gear reducers permit increasing of the hoisting speed or increasing of the lifted weight, or both, without making the winch (tubular support enclosure 21) wider than 8 inches while still maintaining all fail safe features of the winch embodiments shown on FIGS. 1 through 16.

In the embodiment shown on FIG. 20 the tubular support enclosure 21, the drum assembly 11B, the sheave assembly 30, the guide block 32 and the control sensor assembly 40 function exactly as described for the embodiment shown on FIGS. 1 through 7 and FIGS. 9 through 16. The frame 12A and bearings (sliding) 127 also function as described for the embodiment shown on FIG. 1, except as shown on FIG. 20, the horizontal member 121A is elongated and another end member 123B is added.

The overspeed brake 15 shown on FIG. 1 is removed and replaced on FIG. 20 with a second motorized gear reducer 13B. The torque ratings of the motorized gear reducers 13A and 13B and their brakes 131A and 131B are selected so that if one motorized gear reducer fails, the other can safely support the entire load suspended from cables 17 with adequate safety factor. Thus the fail safe feature previously provided by the overspeed brake 15 on FIG. 1 is maintained.

Looking again at FIG. 1, the power transmission screw 25, the screw support 23 the power transmission nut 114 and the screw connector 24 are eliminated and these functions are performed by the connecting shaft 28 and power transmission nut 114B.

As shown on FIG. 20, the connecting shaft has a power transmission thread 25B machined into its outer surface. A power transmission nut 114B, with matching thread, is bolted to the tubular support enclosure 21 and engages the thread 25B of the connecting shaft 28. The pitch of the thread 25B is equal to the pitch of the drum assembly 11 cable grooves. Therefore, when the drum assembly 11 rotates, it translates the winch unit 10 in the longitudinal direction of the tubular support enclosure 21 in synchronization with the back and forth wrapping of the cables 17 on the drum assembly 11B grooves. Straight cable paths are maintained between the drum assembly 11B and sheaves 313.

The drum assembly 11B can be mounted directly on the shaft 132 of the motorized gear reducer 13A at one end and can be supported at its other end by bearing 14 installed into member 123A.

The connecting shaft 28 can be directly fastened to the motorized gear reducer 13B output shaft 132 at one end and to the drum 11B hub at its other end. As an alternate, couplings (not shown) can be used for fastening the connecting shaft 28 to the motorized gear reducer 13B and drum assembly 11B. The connecting shaft 28 can be also designed as a rigid extension of drum assembly 11B and the member 123A with bearing 14 can then be removed. In this case the support 125 with the sliding bearings 127 can be located at or near the end member 123B.

While the embodiment of the winch shown on FIG. 20 is described with sliding bearings 127 supporting the winch unit 10 from its tubular support enclosure 21, a modification with rollers 127A, as shown on FIGS. 17 and 18 can be used.

While the invention has been described in connection with preferred embodiments, it will be understood that modifications thereof within the principles outline above will be evident to those skilled in the art and thus the invention is not limited to the preferred embodiments but is intended to encompass such modifications.

What is claimed is:

1. An improved motorized winch for raising and lowering an object with respect to a facility, comprising:

an elongated tubular support enclosure having a longitudinal axis and having elongated connected top, bottom and side walls extending in the direction of the longitudinal axis and having means for mounting in a fixed position with respect to the facility, cable guiding means for receiving and guiding cables, said cable guiding means being mounted on and supported by the top or bottom wall of the tubular support enclosure, the supporting top or bottom wall having access openings for the passage of cables, winch-unit-bearing support means mounted inside of and to the tubular support enclosure, a winch unit having components and located inside and supported by the tubular support enclosure and having spaced portions rollably or slidably engaged and supported by the winch-unit-bearing support means for longitudinal movement by the winch unit within and relative to the tubular support enclosure, the winch unit comprising:

an elongated drum having a longitudinal axis and having on its outside a helical groove configured to receive adjacent strands of a cable and mounted for rotation about and translation relative to its longitudinal axis on its support means inside the tubular support enclosure, one or more cables engaging the drum grooves and passing from the outside of the drum through the access openings in the supporting top or bottom wall to and over the cable guiding means to the object, each cable when wound up on the drum occupying an axially-extending section of the drum grooves having a given length, drive means for rotating the drum, the top, bottom, and side walls of the tubular support enclosure extending at least over the drum in the longitudinal direction, said drum, cables and cable guiding means being connected such that rotation of the drum causes each cable to wind or unwind on or off the drum grooves to move the object up or down with respect to the facility while simultaneously translating back and forth, parallel to its longitudinal axis, relative to the tubular support enclosure in synchronization with the rotation of the drum controlling the cable runs to their respective cable guiding means to achieve zero fleet angle while the drum is translated over the given length of the axially-extending section, the mounting of the winch components and the cable guiding means being confined within a right quadrangular prismatic volume defined by the tubular support enclosure side walls and straight prolonged imaginary extensions of the side walls such that plural winches can be mounted side-by-side without winch component interference, said tubular support enclosure having means providing access to the winch unit for maintenance and repairs.

2. A motorized winch as set forth in claim 1, wherein the winch-unit-bearing support means comprises rollers mounted to the inside of the tubular support enclosure.

3. A motorized winch as set forth in claim 2, further comprising sliding bearings, mounted on the winch unit, and slidably engaging an inside surface of the tubular support enclosure.

4. A motorized winch as set forth in claim 1, wherein the winch unit comprises at opposite ends a support member having top and bottom bearing surfaces, the winch-unit-bearing support means comprising at each end of the winch unit two rollers, respectively engaging and supporting the bottom bearing surface of each of the support members.

5. A motorized winch as set forth in claim 4, wherein the winch-unit-bearing support means comprises at each end of the winch unit two rollers, respectively engaging and supporting the top bearing surface of each of the bearing support members.

6. A motorized winch as set forth in claim 4, wherein the winch-unit-bearing support means comprises at each end of the winch unit two sliders respectively engaging a bearing surface of the tubular support enclosure.

7. A motorized winch as set forth in claim 4, wherein the tubular support enclosure comprises internal ridged sections for engaging the bearing support members and forming backup support for the winch unit.

8. An improved motorized winch for raising and lowering objects with respect to a facility, comprising:

a tubular support enclosure having means for mounting in a fixed position with respect to the facility and means for access for maintenance and repairs, cable guiding means mounted to and supported by the outside of the tubular enclosure for receiving and guiding cables, winch-unit-bearing support means mounted inside of and to the tubular support enclosure, a winch unit mounted inside the tubular support enclosure and supported by the winch-unit-bearing support means, the winch unit comprising:

a single elongated drum having first and second opposite ends and cable grooves and having a longitudinal axis and mounted for rotation and translation relative to its longitudinal axis on slidable or rollable supports inside the tubular support enclosure, one or more cables engaging the cable grooves and passing from the outside of the drum over the cable guiding means to the lifted object, at least first and second motor drive means for rotating the drum, the first motor drive connected to the first end of the drum, the second motor drive connected to the second end of the drum, said drum, cables and cable guiding means being connected such that rotation of the drum causes the cables selectively to wind or unwind on or off the drum grooves to move the object up or down with respect to the facility while simultaneously translating back and forth, parallel to its longitudinal axis, relative to the tubular support enclosure in synchronization with the rotation of the drum controlling the cable runs to their respective cable guiding means, an axially-movable frame rollably or slidably mounted within and supported by the tubular support enclosure, the drum and motor drive means being mounted on the frame for access for maintenance and repairs, wherein the winch-unit-bearing support means comprises rollers mounted to the tubular support enclosure and sliding bearings, mounted on the winch unit, and slidably engaging an inside surface of the tubular support enclosure.

9. A motorized winch as set forth in claim 8, wherein the drum has a power transmission thread, further comprising a block or rollers with threads matching the power transmission thread and mounted inside of the tubular support enclosure, the block or roller and power transmission thread cooperating to provide the translating back and forth motion of the drum when rotated.

10. A motorized winch as set forth in claim 8, further comprising a block or rollers having threads matching the drum cable grooves and mounted inside of the tubular support enclosure, the block or roller threads and drum cable grooves cooperating to provide the translating back and forth motion of the drum when rotated.

11. A motorized winch as set forth in claim 8, further comprising a connecting shaft between one of the drive means and the drum with the connecting shaft having a power transmission thread on its outer surface, a nut or roller with threads matching the power transmission thread mounted inside of the tubular support enclosure, the nut or roller threads and shaft thread cooperating to provide the translating back and forth motion of the drum when rotated.

12. A motorized winch as set forth in claim 11, wherein the connecting shaft is a rigid extension of the drum.

13. A motorized winch as set forth in claim 8, wherein the mounting of the winch components and the cable guiding means are confined within a right quadrangular prismatic volume defined by the enclosure side walls and straight prolonged imaginary extensions of the side walls such that plural winches can be mounted side-by-side without winch component interference.

14. A motorized winch as set forth in claim 8, further comprising, mounted inside and to the tubular support enclosure, spaced rollers engaging and supporting the winch-unit for longitudinal movement by the winch unit within the tubular support enclosure.

* * * * *